US012612224B2

(12) United States Patent
Wong et al.

(10) Patent No.: US 12,612,224 B2
(45) Date of Patent: Apr. 28, 2026

(54) LID ASSEMBLY WITH SELECTABLE OUTLETS

(71) Applicant: KING'S FLAIR MARKETING LIMITED, Tortola (VG)

(72) Inventors: Siu Wah Wong, Tortola (VG); Fat Sun Kwok, Tortola (VG); Shun Sang Poon, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 239 days.

(21) Appl. No.: 18/654,507

(22) Filed: May 3, 2024

(65) Prior Publication Data

US 2024/0375833 A1 Nov. 14, 2024

Related U.S. Application Data

(60) Provisional application No. 63/464,757, filed on May 8, 2023.

(51) Int. Cl.
*B65D 47/28* (2006.01)
*B65D 47/24* (2006.01)

(52) U.S. Cl.
CPC ..... *B65D 47/286* (2013.01); *B65D 47/24* (2013.01)

(58) Field of Classification Search
CPC ..... B65D 47/86; B65D 47/24
(Continued)

(56) References Cited

U.S. PATENT DOCUMENTS

2019/0092540 A1* 3/2019 Spivey ..... B65D 43/165
2021/0354888 A1* 11/2021 Wong ..... B65D 47/061
2021/0354889 A1* 11/2021 Wong ..... A47G 19/2272

FOREIGN PATENT DOCUMENTS

CN 103445621 A * 12/2013
CN 216293695 U * 4/2022

OTHER PUBLICATIONS

Machine Translation of CN-103445621-A.*
Machine Translation of CN-216293695-U.*

* cited by examiner

*Primary Examiner* — Jeremy Carroll
(74) *Attorney, Agent, or Firm* — WPAT, PC

(57) ABSTRACT

The present invention is related to a lid assembly, for a container, comprising: a base plate suitable for assembling to said container, configured to provide a first opening and a second opening, the underside of said base plate is provided with a pair of connecting members; an axle, a first seal, a second seal, a first biasing member, and a second biasing member; a first lever arm, positioned below said first opening of said base plate and pivotably connected to said pair of connecting members via said axle and said first biasing member such that said first lever arm can be reciprocally biased between a first position where said first lever arm closing said first opening of said base plate with said first seal and a second position where said first lever arm being away from said first opening of said base plate; a second lever arm, positioned below said second opening of said base plate and pivotably connected to said pair of connecting members via said axle and said second biasing member such that said second lever arm can be reciprocally biased between a first position where said second lever arm closing said second opening of said base plate with said second seal and a second position where said second lever arm being away from said second opening of said base plate, wherein said second lever arm is provided to have an engagement member receivable in said second opening of said base plate; and a trigger comprising a first opening and an actuating portion, said trigger is configured to slide on the top side of said base plate between a first position where said first opening of said trigger being over said first opening of
(Continued)

said base plate position and a second position where said actuating portion interacting with said engagement member of said second lever arm such that said second lever arm being biased to its said second position.

20 Claims, 26 Drawing Sheets

(58) Field of Classification Search
USPC ..... 222/478
See application file for complete search history.

LID ASSEMBLY WITH SELECTABLE OUTLETS

FIELD OF THE INVENTION

This invention relates to a drinking bottle for drinking liquids. Specifically, the present invention relates to a lid assembly having selectable outlets for a drinking bottle. Users may select one of the outlets according to their needs.

BACKGROUND OF THE INVENTION

Many individuals enjoy both hot and cold beverages throughout the day, and the need for a container that caters to this preference is evident. By incorporating a dual-outlet lid assembly in a single container, users can conveniently carry and enjoy different types of drinks without the hassle of multiple containers or constantly switching lids. This solution offers a practical and convenient option for individuals who prefer to have their beverages readily available in a single container. The versatility provided by the dual-outlet lid assembly is a significant advantage. One outlet can be specifically designed for sipping hot beverages such as coffee, tea, or hot chocolate, while the other outlet, equipped with a straw, is ideal for enjoying cold beverages like iced coffee, smoothies, or soft drinks. This flexibility accommodates a wider range of consumer preferences and beverage choices, ensuring that each drink can be enjoyed to its fullest. The market for beverages is incredibly diverse, and consumers have varying preferences when it comes to their beverage consumption. By offering a container with a lid assembly that caters to both hot and cold beverages, with dedicated outlets for each, companies can acknowledge and accommodate these preferences. This approach provides a solution that aligns with the needs and desires of a wide range of consumers, enhancing their overall experience.

In addition to convenience and consumer satisfaction, a container with a dual-outlet lid assembly also promotes eco-friendly practices. Instead of relying on separate disposable cups or containers for hot and cold beverages, individuals can reduce waste by utilizing a single reusable container. This environmentally conscious approach contributes to the reduction of single-use plastic and supports sustainable practices in the market.

By addressing the need for convenience, versatility, and sustainability, the present invention provides a novel solution to cater the demand for a beverage container equipped with a lid assembly that provides selectable outlets. Alternatively, the present invention at least provides an alternative to the public.

SUMMARY OF THE INVENTION

The first aspect of the present invention is related to a lid assembly, for a container, comprising: a base plate suitable for assembling to said container, configured to provide a first opening and a second opening, the underside of said base plate is provided with a pair of connecting members; an axle, a first seal, a second seal, a first biasing member, and a second biasing member; a first lever arm, positioned below said first opening of said base plate and pivotably connected to said pair of connecting members via said axle and said first biasing member such that said first lever arm can be reciprocally biased between a first position where said first lever arm closing said first opening of said base plate with said first seal and a second position where said first lever arm being away from said first opening of said base plate; a second lever arm, positioned below said second opening of said base plate and pivotably connected to said pair of connecting members via said axle and said second biasing member such that said second lever arm can be reciprocally biased between a first position where said second lever arm closing said second opening of said base plate with said second seal and a second position where said second lever arm being away from said second opening of said base plate, wherein said second lever arm is provided to have an engagement member receivable in said second opening of said base plate; and a trigger comprising a first opening and an actuating portion, said trigger is configured to slide on the top side of said base plate between a first position where said first opening of said trigger being over said first opening of said base plate position and a second position where said actuating portion interacting with said engagement member of said second lever arm such that said second lever arm being biased to its said second position.

In some embodiments, said first lever arm and said second lever arm are coaxially connected to said connecting member of said base plate via said axle.

Preferably, said first biasing member and said second biasing member are integrally formed.

In some embodiments, the top side of said base plate is provided with a chute inside which said first opening and said second opening of said base plate are arranged, said chute is profile to have a pair grooves at the laterals sides allowing said trigger sliding therein.

Preferably, said chute is provided with a stopper aiding to hinder the sliding of said trigger from its said first position to its said second position.

Preferably, said chute having a slope portion where said second opening of said base plate is arranged.

In some embodiments, the underside of said base plate is provided with a pair of legs for securely receiving said pair of connecting members.

Advantageously, said pair of legs are made of resilient materials.

Advantageously, said pair of legs each is provided with a finger for securely receiving said pair of connecting members.

Advantageously, said axle, said first biasing member, said second biasing member, said first lever arm, said second lever arm, said connecting member can be assembled as a module before assembling to said base plate.

More advantageously, said assembly is free of screw.

The second aspect of the present invention is related to a lid assembly, for a container, comprising: a base plate suitable for assembling to said container, configured to provide a first opening and a second opening, the underside of said base plate is provided with a pair of connecting members; a first lever system comprising a first lever arm and a first biasing member, said first lever system positioned below said first opening of said base plate and is pivotably connected to said pair of connecting members in a biased manner by means of said first biasing member, such that said first lever system can be reciprocally biased between a first position where said first lever arm closing said first opening of said base plate with a first seal and a second position where said first lever arm being away from said first opening of said base plate; a second lever arm system comprising a second lever arm and a second biasing member, said second lever system positioned below said second opening of said base plate and is pivotably connected to said pair of connecting members in a biased manner by means of said second biasing member, such that said second lever system can be reciprocally biased between a first position where said second lever arm closing said second opening of said base plate with a second seal and a second position where said second lever arm being away from said second opening of said base plate, wherein said second lever arm is provided to have an engagement member receivable in said second opening of said base plate; a trigger comprising a first opening and an actuating portion, said trigger is configured to slide on the top side of said base plate between a first position where said first opening of said trigger being over said first opening of said base plate position and a second position where said actuating portion interacting with said engagement member of said second lever arm such that said second lever arm being biased to its said second position.

In some embodiments, the top side of said base plate is provided with a chute inside which said first opening and said second opening of said base plate are arranged, said chute is profile to have a pair grooves at the laterals sides allowing said trigger sliding therein. Preferably, said chute is provided with a stopper aiding to hinder the sliding of said trigger from its said first position to its said second position. More preferably, said chute having a slope portion where said second opening of said base plate is arranged.

In some embodiments, said first lever arm and said second lever arm are coaxially connected to said connecting member of said base plate via a common axle. In another embodiments, said first lever arm is pivotably connected to said pair of connecting members via a first axle and said first biasing member such that said first lever arm can be reciprocally biased between its first position and second position; and said second lever arm is pivotably connected to said pair of connecting members via a second axle and said second biasing member such that said second lever arm can be reciprocally biased between its first position and second position.

In some embodiments, wherein the underside of said base plate is provided with a pair of legs made of resilient materials for securely receiving said pair of connecting members, wherein said pair of legs each is provided with a finger for securely receiving said pair of connecting members. Advantageously, said first lever system, said second lever system, and said connecting member can be assembled as a module before assembling to said base plate. In some embodiments, said first lever arm and said second lever arm are coaxially connected to said connecting member of said base plate via a common axle. In another embodiments, wherein said first lever arm is pivotably connected to said pair of connecting members via a first axle and said first biasing member such that said first lever arm can be reciprocally biased between its first position and second position; and said second lever arm is pivotably connected to said pair of connecting members via a second axle and said second biasing member such that said second lever arm can be reciprocally biased between its first position and second position.

DESCRIPTION OF THE DRAWINGS

Some embodiments of the present invention will now be explained, with reference to the accompanied drawings, in which:—

DETAILED DESCRIPTION OF THE PREFERRED EMBODIMENT

Figure 1:
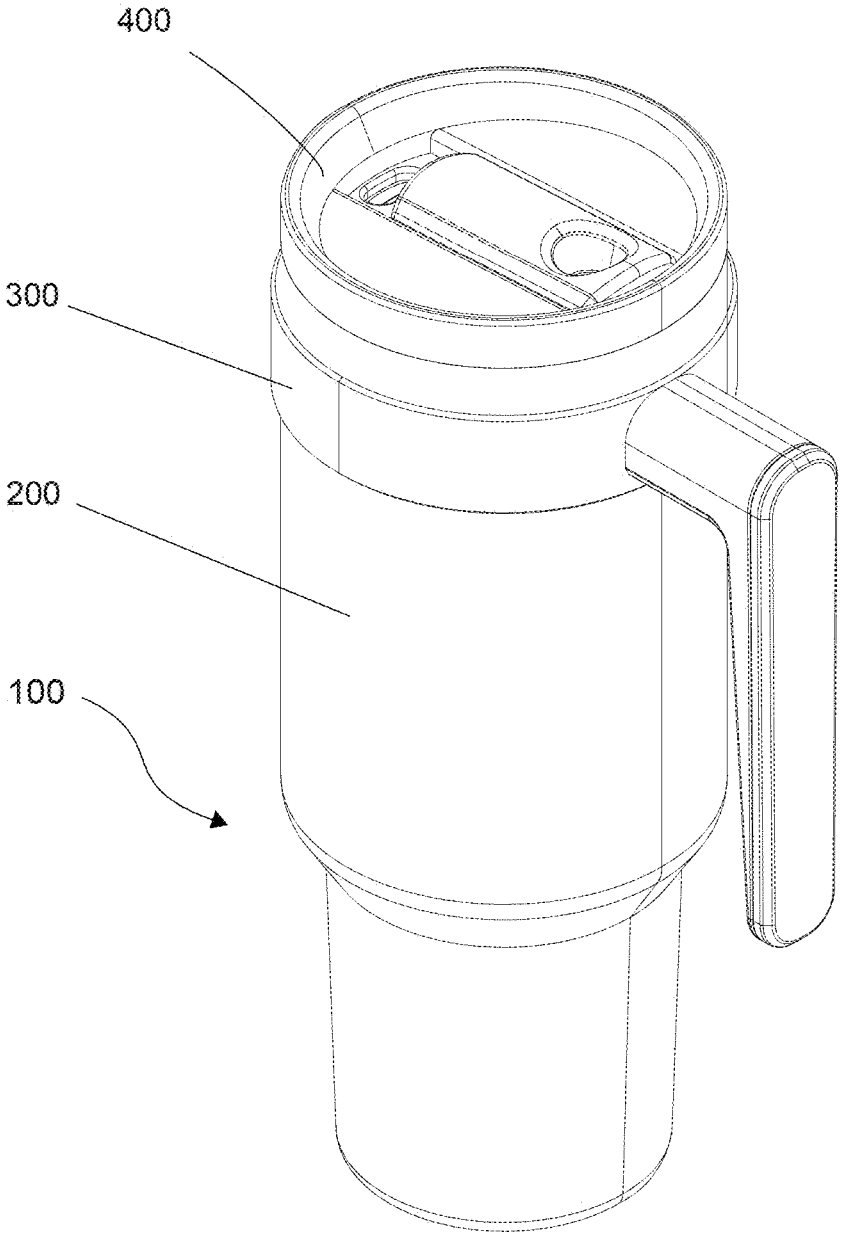
FIG. 1 shows the first embodiment of the drinking bottle of the present invention.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. “First”, “second” and similar expression used in the embodiments of the present invention do not indicate any order, quantity or importance, but are only used to distinguish different components. “Front”, “rear”, “left”, “right”, “upper”, and “lower” and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Figure 2:
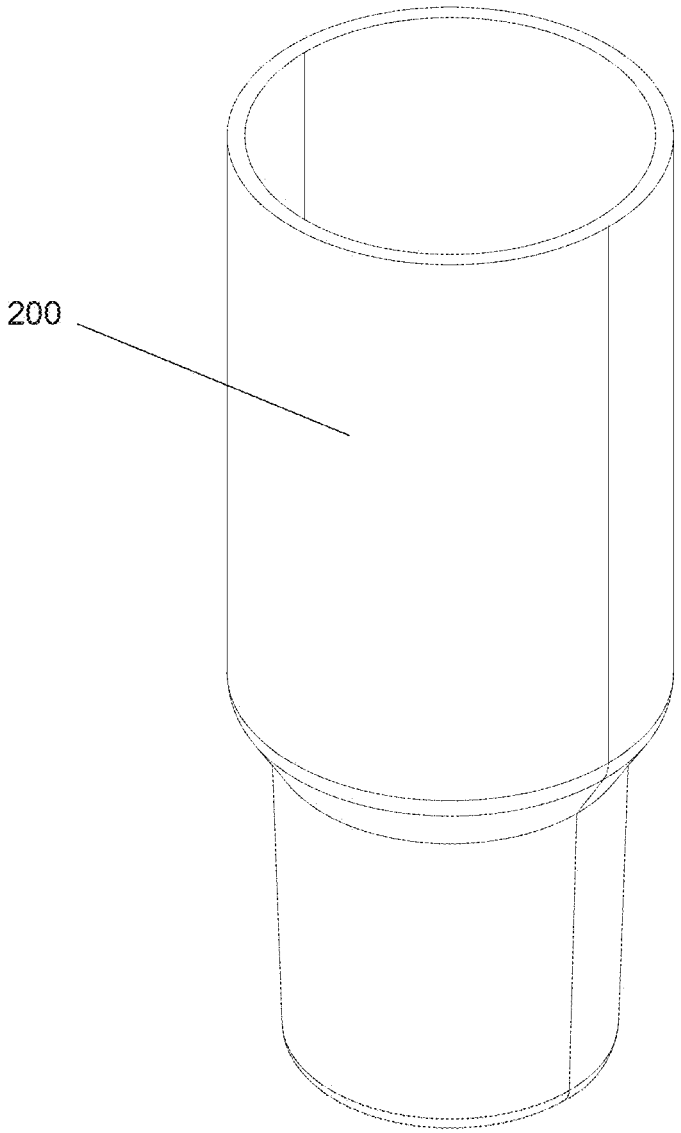
FIG. 2 shows the base member of the drinking bottle.
Figure 3:
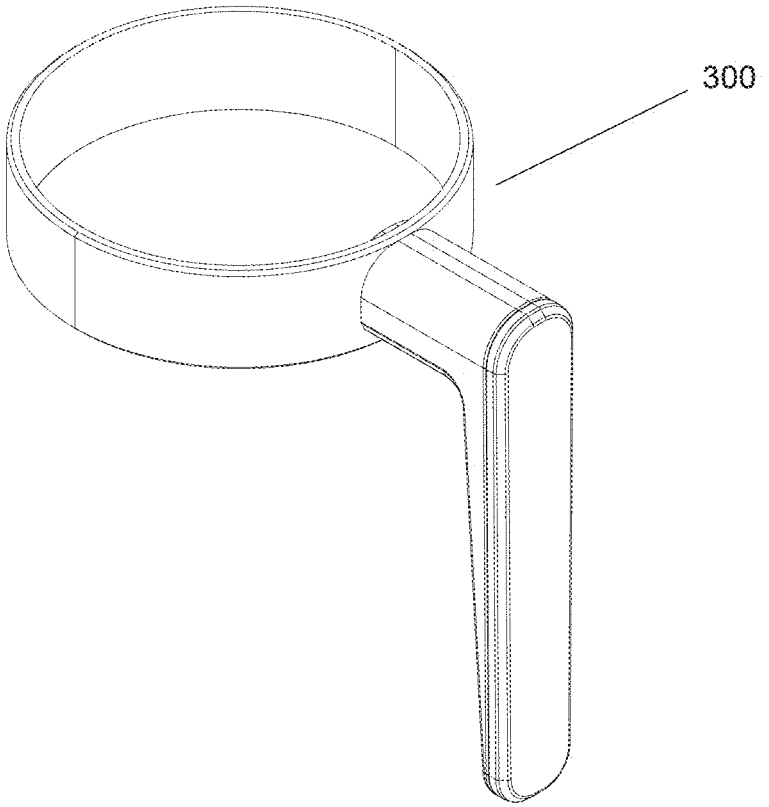
FIG. 3 shows the handling member.

FIG. 1 shows a drinking bottle denoted with reference numeral 100, being the first embodiment of the present invention. The drinking bottle 100 comprises a base member 200, a handling member 300, and a lid assembly 400 placed on top of the base member 200 allowing the general understanding on terms such as "up and down", "above and under", "front and rear", "top and bottom", "horizontal, vertical/vertical", "high and low" are used in this context to express relative direction or location, definition of which is equivalent to the spatial arrangement illustrated in the figures in a direction into the sheet of figures. FIG. 2 shows the base member 200 comprising cylindrical peripheral wall and an open-top opening, it is designed in cylindrical profile to contain water, drinks or other beverages for consumption. FIG. 3 shows the handling member 300 comprising an opening that is sized and dimensioned fit to the diameter of the cylindrical peripheral wall of the base member. Together with FIGS. 1-3, it shall be understood that the handling member 300 is assembled to the base member 200 by passing the opening of the handling member 300 through the cylindrical peripheral wall of the base member 200.

Figure 4:
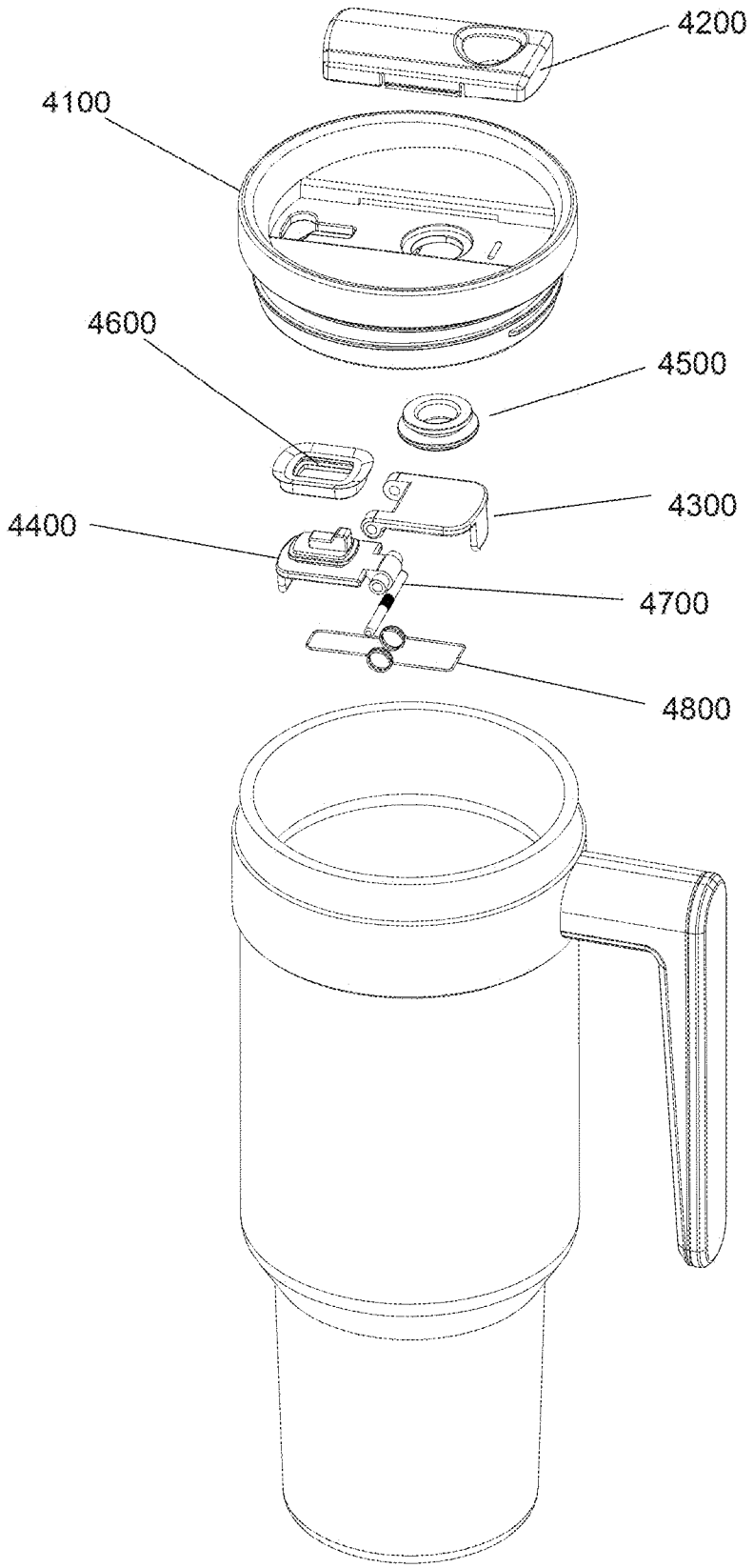
FIG. 4 is an exploded view of the lid assembly.

FIG. 4 is an exploded view of the lid assembly 400 comprising a base plate 4100, a trigger 4200, a first lever arm 4300, a second lever arm 4400, a first seal 4500, a second seal 4600, an axle 4700, and a bias member 4800.

Figure 5C:
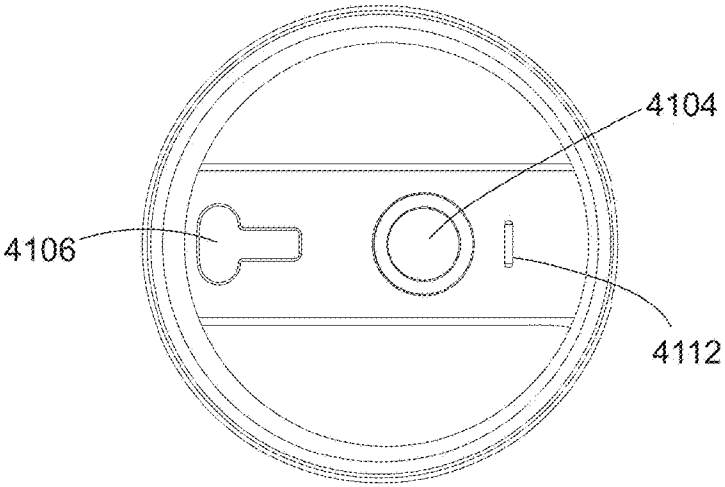
FIGS. 5A-5D shows the base plate in different views.
Figure 5D:
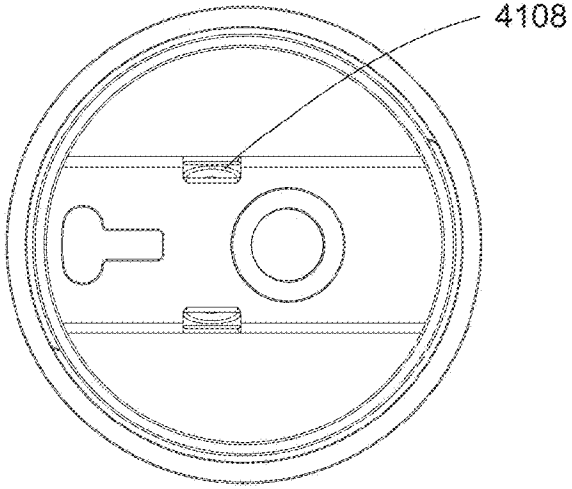
Figure 5A:
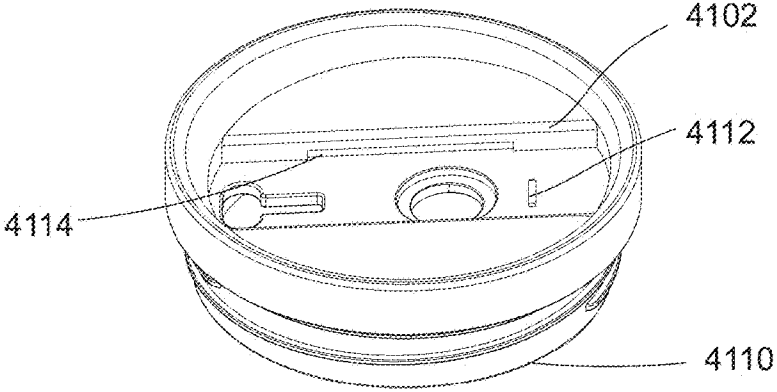
Figure 5B:
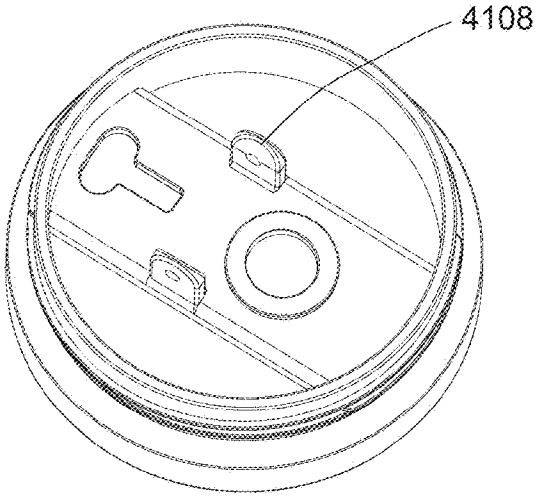

FIGS. 5A-5D shows the base plate 4100 in different views, in which FIG. 5A is the perspective top view; FIG. 5B is a perspective bottom view; FIG. 5C is an elevation view; and FIG. 5D is a bottom view. It can be seen that the lower portion of the base plate 4100 is provided an engagement member 4110 that fits the size of the open-top opening of the base member 200. It would be within the ability of a person skilled in the art that the lid assembly can be clipped or screwed onto the base member by push fit or threads in a standard manner. The top surface of the base plate is provided with a chute 4102 profiled in rectangular shape. In FIG. 5C, in the chute is provided with a first aperture 4104, a second aperture 4106 adjacent the first aperture 4104, and a stopper 4112. On the lateral sides of the chute 4102, there is provided with grooves 4114. Referring to FIG. 5B, it can be seen that the underside of the top surface is provided with a pair of connecting members 4108 each with hole provided thereon. Preferably, connecting members 4108 are made elastic.

Figure 6D:
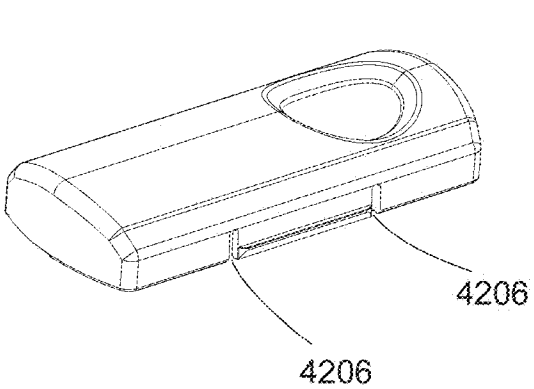
FIGS. 6A-6E shows the trigger in different views.
Figure 6E:
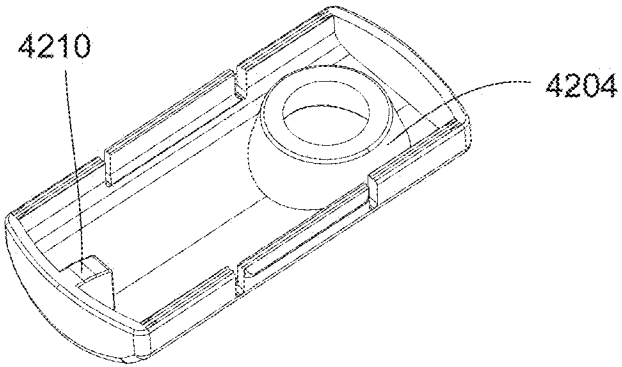
Figure 6A:
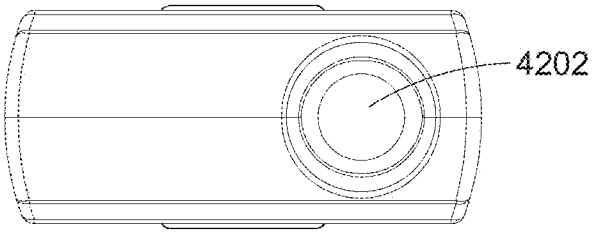
Figure 6B:
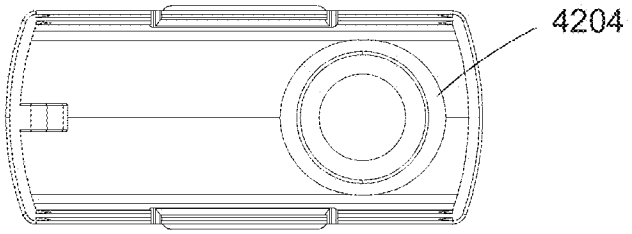
Figure 6C:
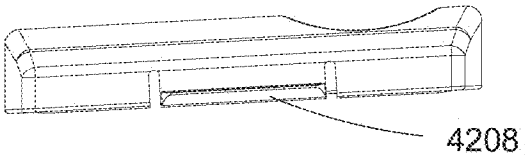

FIGS. 6A-6E shows the trigger 4200 in different views, in which FIG. 6A is an elevation view, FIG. 6B is a bottom view, FIG. 6C is a side view, FIG. 6D is a perspective top view, and FIG. 6E is a perspective bottom view. FIG. 6A shows that the trigger 4200 for example in a form of a slider, where the top side of the trigger is provided with a first aperture 4202 thereon. The first aperture 4202 is a through hole. On the underside of the top side of the trigger is provided with a collar 4204 and an actuating portion 4210 opposite said collar 4204 (see FIG. 6E). On the lateral sides of the trigger is provided with slits 4206, dividing the lateral sides of the trigger into portions to ease the assembling of the trigger into the chute 4102 of the base plate 4100. As seen in FIG. 6C, it can be seen that the middle portion of the lateral sides of the trigger 4200 is provided with lateral fingers 4208 providing ease to assembling the trigger 4200 into the chute 4102 by receiving the lateral fingers 4208 into the grooves 4114 of the base plate 4100. Preferably, the length of the grooves 4114 is longer than the length of the lateral fingers. By position the lateral fingers of the trigger into the grooves of the base plate, the trigger 4200 is slidable in the chute 4102 between a first position where the first aperture 4202 of the trigger 4200 is over the first aperture 4104 of the base plate 4100 and a second position where the second aperture 4106 of the base plate 4100 is exposed. Preferably, in said first position, the second aperture 4106 is out of sight. More preferably, in said second position, the first aperture 4104 is out of sight. For the sake to hold the position of the trigger 4200 into said first position by preventing it from sliding towards said second position, or vice versa, it is advantageous to provide the base plate 4100 with the stopper 4112 for interfering the sliding of the trigger 420. Advantageously, the stopper 4112 is in a form of bulge disposed in the chute 4102, as illustrate in FIG. 5C.

Figure 7A:
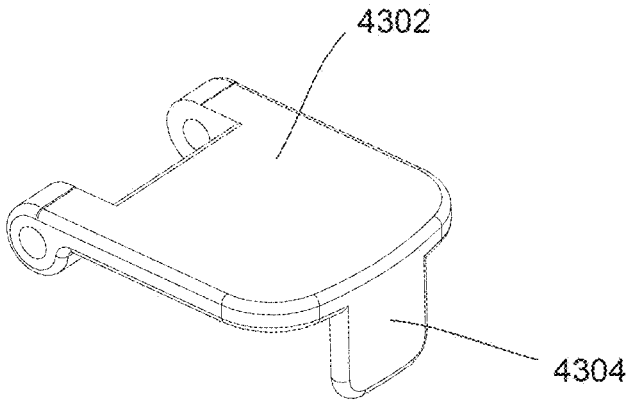
FIGS. 7A-7B shows the first lever arm in different views.
Figure 7B:
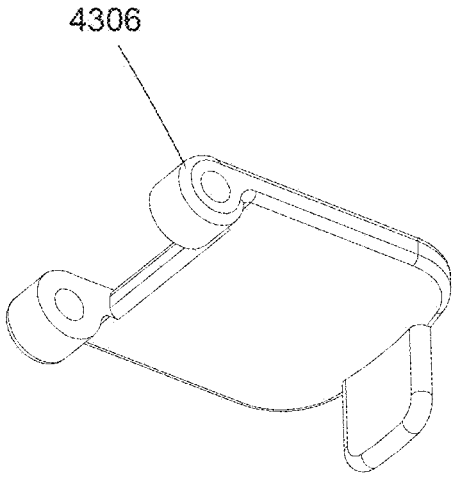

FIGS. 7A-7B shows the first lever arm in different views, in which FIG. 7A is a perspective top view and FIG. 7B is a perspective bottom view. As seen, the first lever arm is profiled to provide a plate 4302 and a handle 4304 extending downwards from the perimeter of the plate 4302. The perimeter of the plate 4302 opposite to the handle 4304 is provided with a pair of connecting members 4306 for example in a form of a pair of gudgeons with holes provided thereon.

Figure 8A:
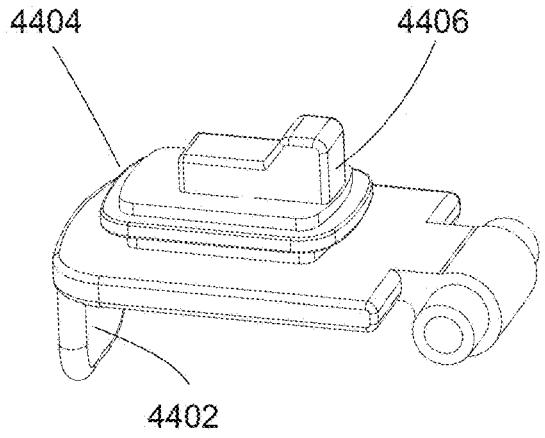
FIGS. 8A-8C shows the second lever arm in different views
Figure 8B:
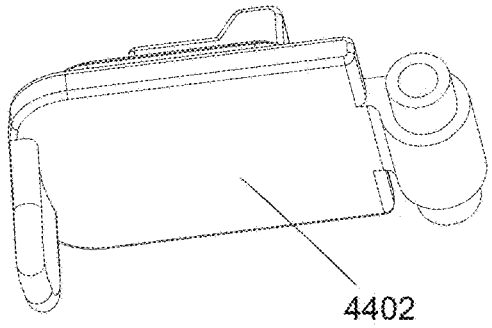
Figure 8C:
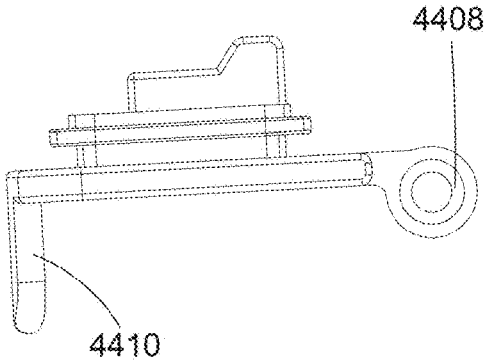

FIGS. 8A-8C shows the second lever arm in different views, in which FIG. 8A is a perspective top view and FIG. 8B is a perspective bottom view and FIG. 8C is a side view. As seen, the second lever arm is profiled to provide a plate 4402 and a handle 4410 extending downwards from the perimeter of the plate 4402. The perimeter of the plate 4402 opposite to the handle 4410 is provided with a pair of connecting members 4408 for example in a form of a pair of gudgeons with holes provided thereon. On top of the plate 4402, there is provided with a seal receiving portion 4404 on which an engagement member 4406 is provided.

Figure 9:
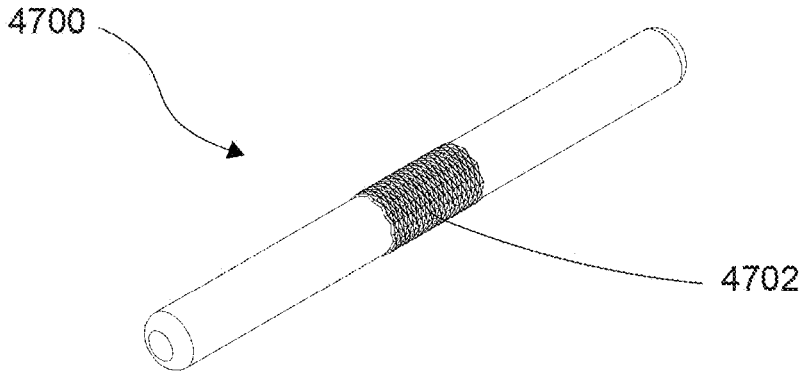
FIG. 9 shows the axle.
Figure 10:
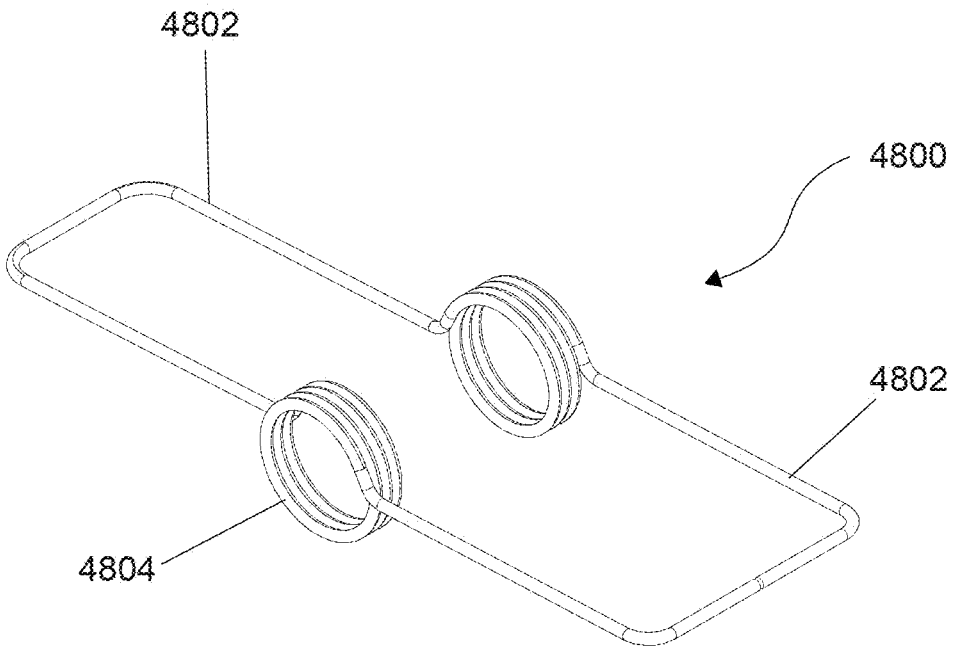
FIG. 10 shows the bias member.
Figure 11B:
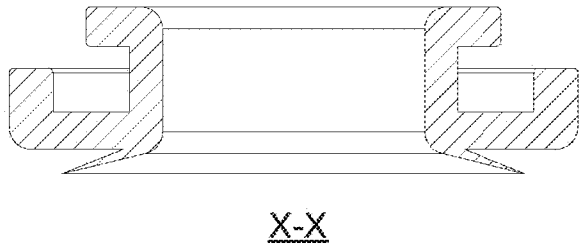
FIGS. 11A-D show the first seal with different angle.
Figure 11D:
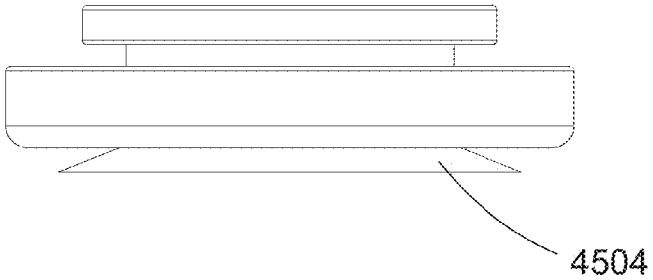
Figure 11A:
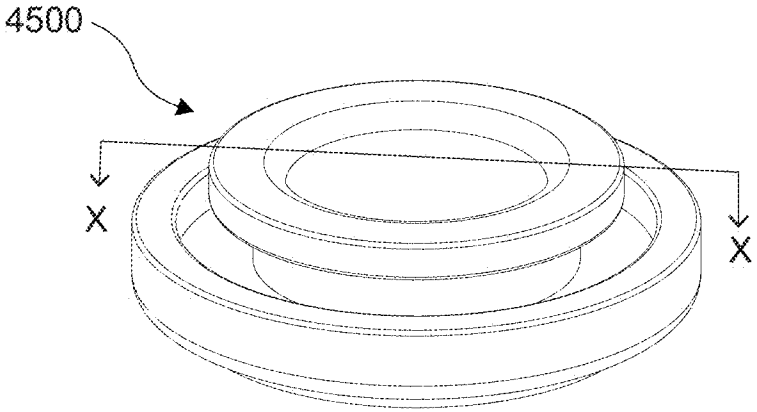
Figure 11C:
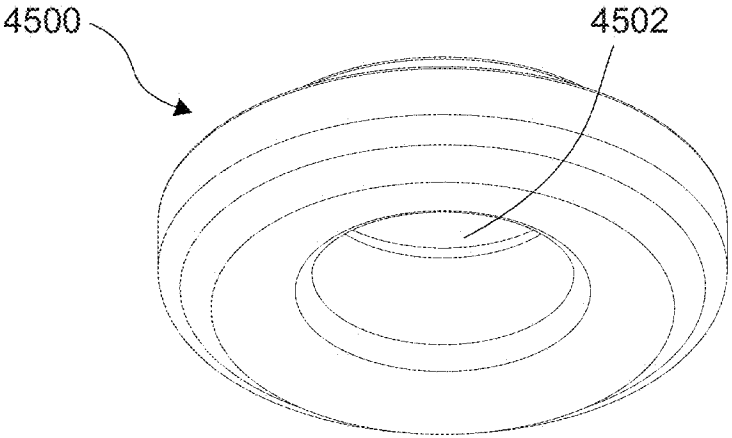
Figure 12:
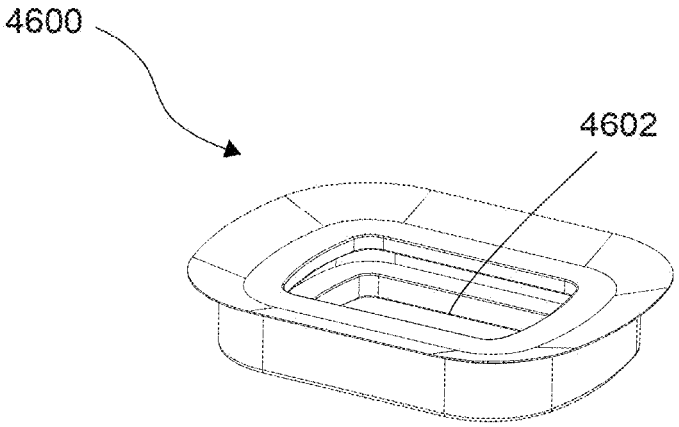
FIG. 12 show the second seal.

FIG. 9 shows the axle 4700 having a frictional portion 4702. FIG. 10 shows the bias member 4800 in a form of a torsion spring as example. The bias member has two wings 4802 laterally extending away from the central torsion springs 4804, each wing shall be regarded as a biasing member. Although FIG. 10 shows there are two coil springs 4804, one skilled in the art could understand that the bias member 4800 could be formed by 1 coil spring or more than 1 coil springs. By default, the bias member 4800 is configured to have a first state. More specifically, each wing 4802 is configured to have a first state, as shown in FIG. 10. Upon compression or pressure, the bias member 4800 is configured to have a second state. More specifically, wing 4802 is configured to have a second state upon compression or pressure thereunder. It shall be understood that the state transition of each wing is independent. It shall also be understood that each wing 4802 can be understood as an independent biasing member which can be operated independently. FIG. 11 show the first seal 4500 with different angles. FIG. 11A is a perspective elevation view, FIG. 11B is a cross-sectional view of the illustration along with the line X-X, FIG. 11C is a perspective bottom view, and FIG. 11D is a side view. The first seal 4500 has an opening 4502 and is sized and shaped to couple with the first aperture 4104 of the base plate 4100, for example, by press-fitting. FIG. 12 show the second seal 4600. The second seal 4600 has an opening 4602 and is sized and shaped to couple with the seal receiving portion 4404 of the second lever arm 4400, for example, by press-fitting. The assembling between the connecting member 4108 of the base plate 4100, the first lever arm 4300, the second lever arm 4400, the first seal 4500, the second seal 4600, the axle 4700, and the bias member 4800 is best seen in FIG. 13 which is a sectional view of the lid assembly 400 with relevant components included.

Figure 13:
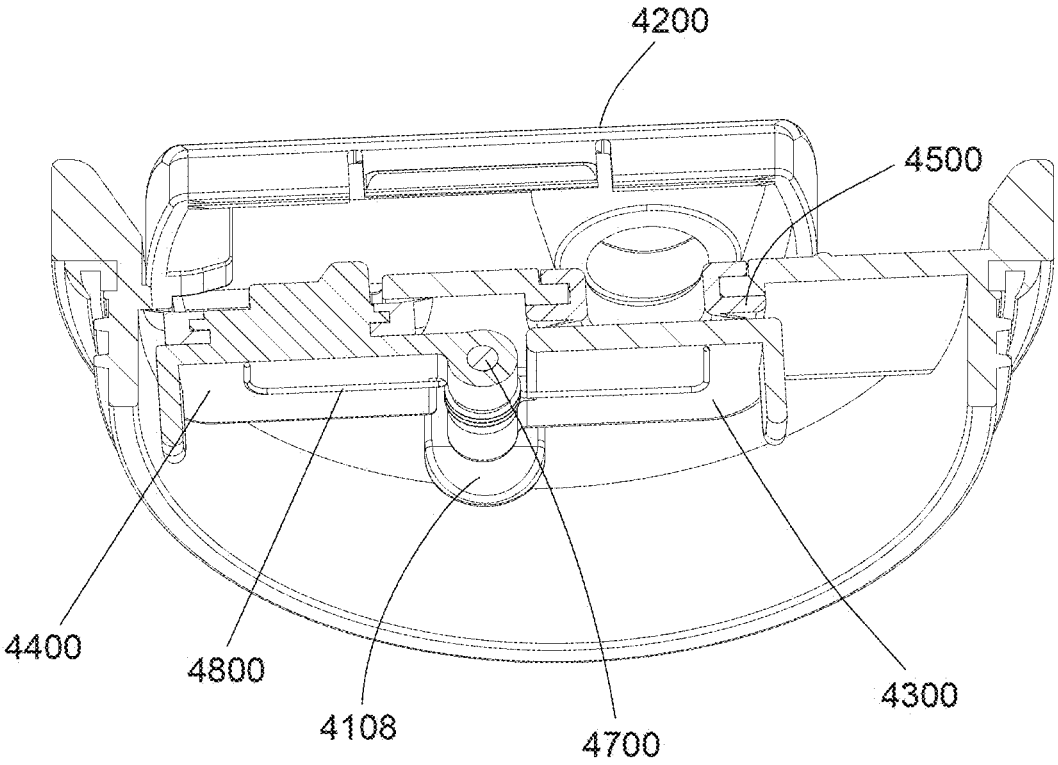
FIG. 13 is a cross-sectional view of the lid assembly.

As seen in FIG. 13, the connecting members 4408 of the second lever arm 4400 are received in the cavity defined by the connecting members 4306 of the first lever arm 4300, in which the bias member 4800 is arranged between the first lever arm 4300 and the second lever arm 4400, such that the plates of the lever arms 4300 and 4400 are respectively positioned on the wings 4802 of the bias member 4800. As seen in FIG. 13, the first lever arm 4300 sits on the right wing 4802, which shall be regarded as sitting on one biasing member; and the second lever arm 4400 sits on the left wing 4802, which shall be regarded as sitting on another biasing member. The axle 4700, with the connecting members 4306 of the first lever arm 4300, the connecting members 4408 of the second lever arm 4400, and the hole of the torsion spring 4804 passing through, is assembled to the base plate 4100 with both ends connected to the connecting members 4108 of the base plate 4100. With assembling as foregoing described, the first lever arm 4300 and the second lever arm 4400 each is rotatable about the axle 4700. With the bias member 4800, it shall be understood that when the first lever arm 4300 is compressed or pressurized downwards, the lever arm displaced pivotally downwards about the axle 4700, whereby biasing the respective wing of the bias member 4800 from its first state to second state. When the foregoing compression or the pressure is removed, the lever arm returns to its original position due to the springy effect of the respective wing of the bias member 4800 changing from the second state to the first state. Operation of the first lever arm 4300 is substantially the same as that for the second lever arm 4400. For the sake of brevity, details on the operation of the second lever arm 4400 is not described. It shall be understood that the elastic connecting members 4108, the handle 4304 and the handle 4110 provide ease to users to dismount the components in the assembly for, for example, washing or replacing worn-out component.

Figure 14A:
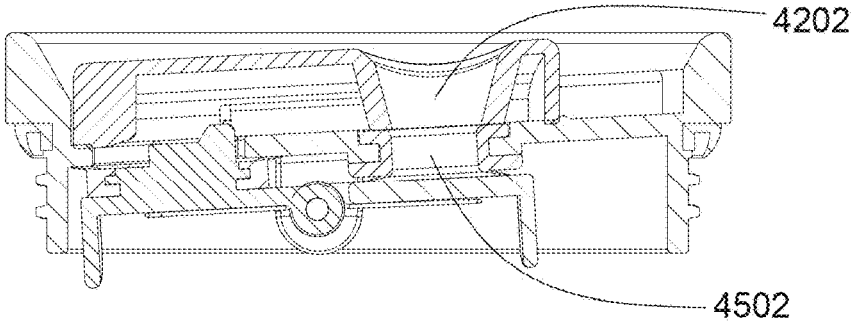
FIGS. 14A-D are schematic drawings showing the sliding of the trigger from its first position towards its second position.
Figure 14B:
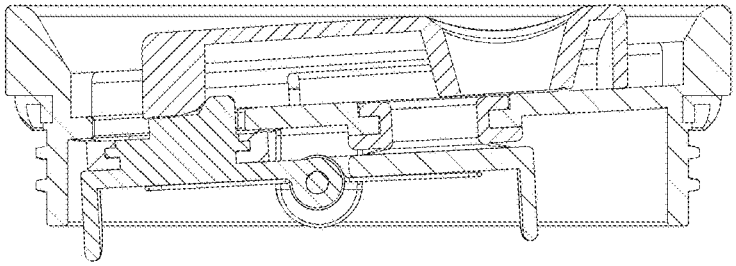
Figure 14C:
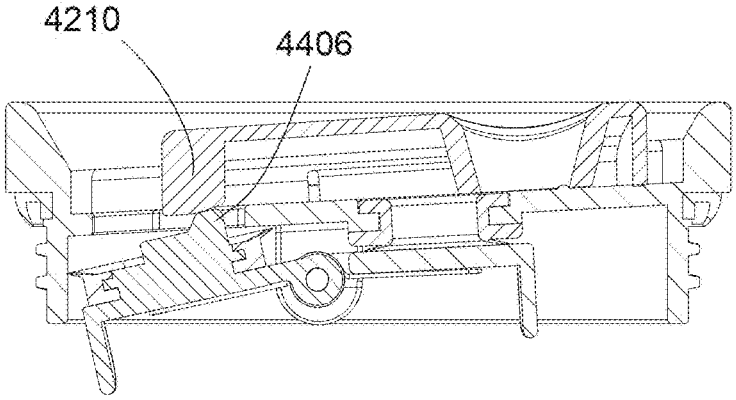
Figure 14D:
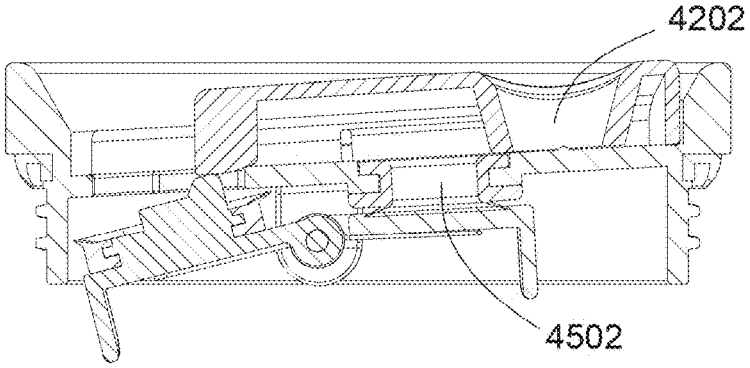

FIGS. 14A-D are schematic drawings showing the sliding of the trigger 4200 moving from its first position (FIG. 14A) towards its second position (FIG. 14D). Specifically, FIGS. 14A-D demonstrates how the trigger moves from the first position where the first aperture 4202 of the trigger 4200 is over the opening 4502 of the first seal 4500 towards its second position where the second aperture 4106 of the base plate 4100 is exposed. When the trigger 4200 moves, as illustrated in FIGS. 14B-C, the actuating portion 4210 of the trigger 4200 slides over the engagement member 4406 of the second lever arm 4400, whereby imposing a downward force to the second lever arm to rotate about the axle 4700. As such, it defines a first passageway between the second aperture 4106 and the cavity of the base member 200 open, liquid inside the base member 200 can be flown out of the drinking bottle through the second aperture 4106 when the drinking bottle is upside down, i.e., the base member 200 is oriented upwards.

Figure 15:
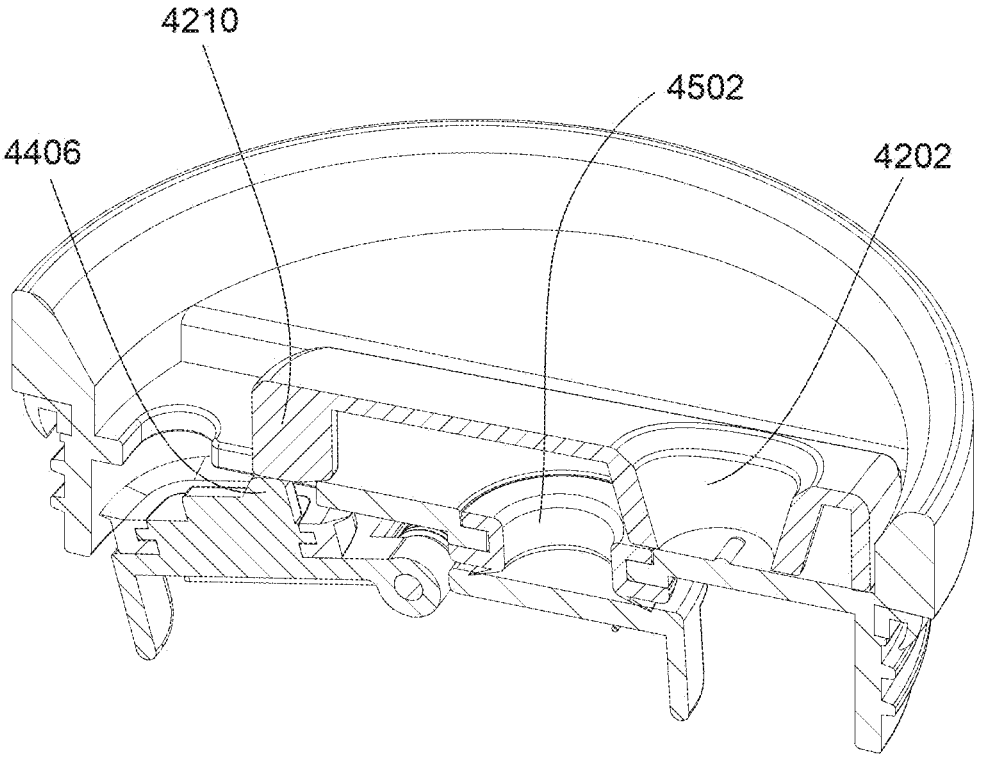
FIG. 15 is a perspective sectional view on the first embodiment of the lid assembly.

FIG. 15 is a perspective sectional view on the lid assembly 400, which corresponds to the state in FIG. 14D.

Figure 16:
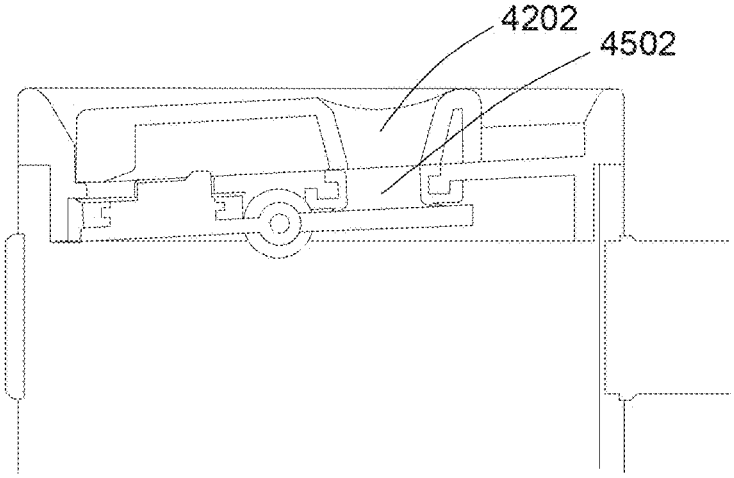
FIGS. 16-18 are schematic drawings showing the sliding of the trigger of the second embodiment of the lid assembly from its first position towards its second position.
Figure 17:
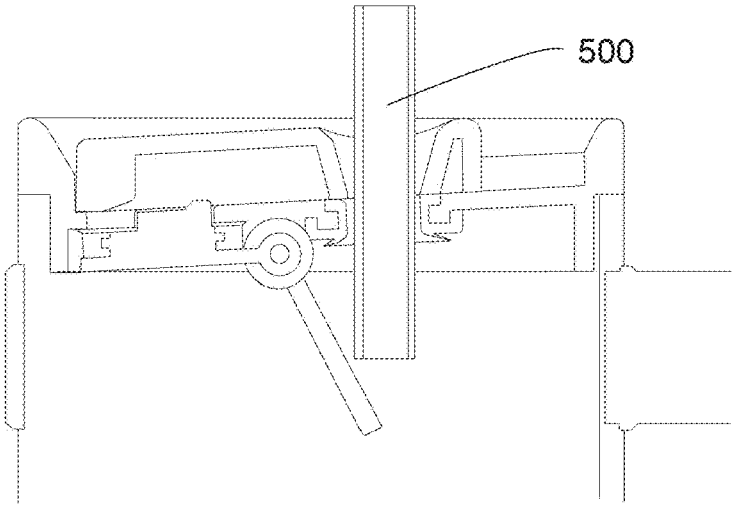
Figure 18:
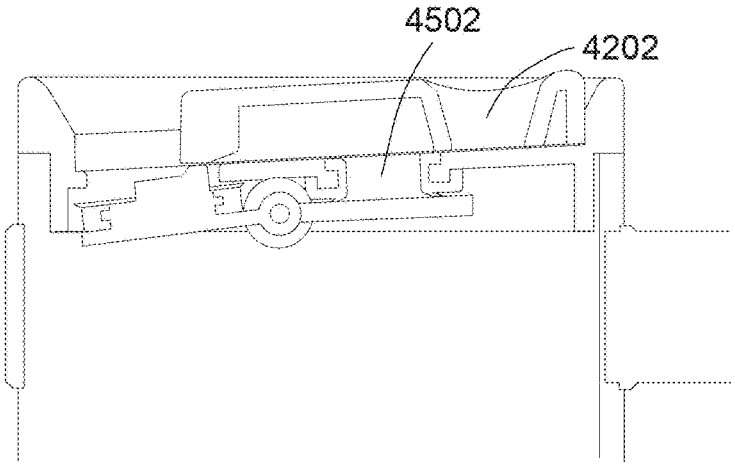

FIGS. 16-18 show a second embodiment of the lid assembly of the present invention. The differences between the first embodiment and the second embodiment substantially reside in the first lever arm and the second lever arm. The operation of the second embodiment is substantially the same as that of the first embodiment. Context below shows the difference between the two embodiments. FIG. 16 shows the trigger is in its first position where the first aperture of the trigger is over the opening of the first seal, which corresponds to the embodiment shown in FIG. 14A. FIG. 17 shows that a drinking tube 500 in a form of a straw is inserted passing through the first aperture of the trigger and the opening of the first seal and is acted on the plate of the first lever arm, imposing a downward force to the first lever arm to rotate about the axle, in which the same operation of the second lever arm described in FIGS. 14A-D. While the drinking tube 500 is inserted further down, users can drink the liquid contained in the base member. As such, it defines a second passageway allowing users drink the liquid. It shall be understood that users can also insert a drinking tube to the embodiment shown in FIG. 14A.

FIG. 18 depicts the actuating portion of the trigger is positioned over the engagement member of the second lever arm, imposing a downward force to the second lever arm to rotate about the axle. As such, it defines a first passageway between the second aperture and the cavity of the base member open, as described in FIGS. 14A-D.

Figure 19:
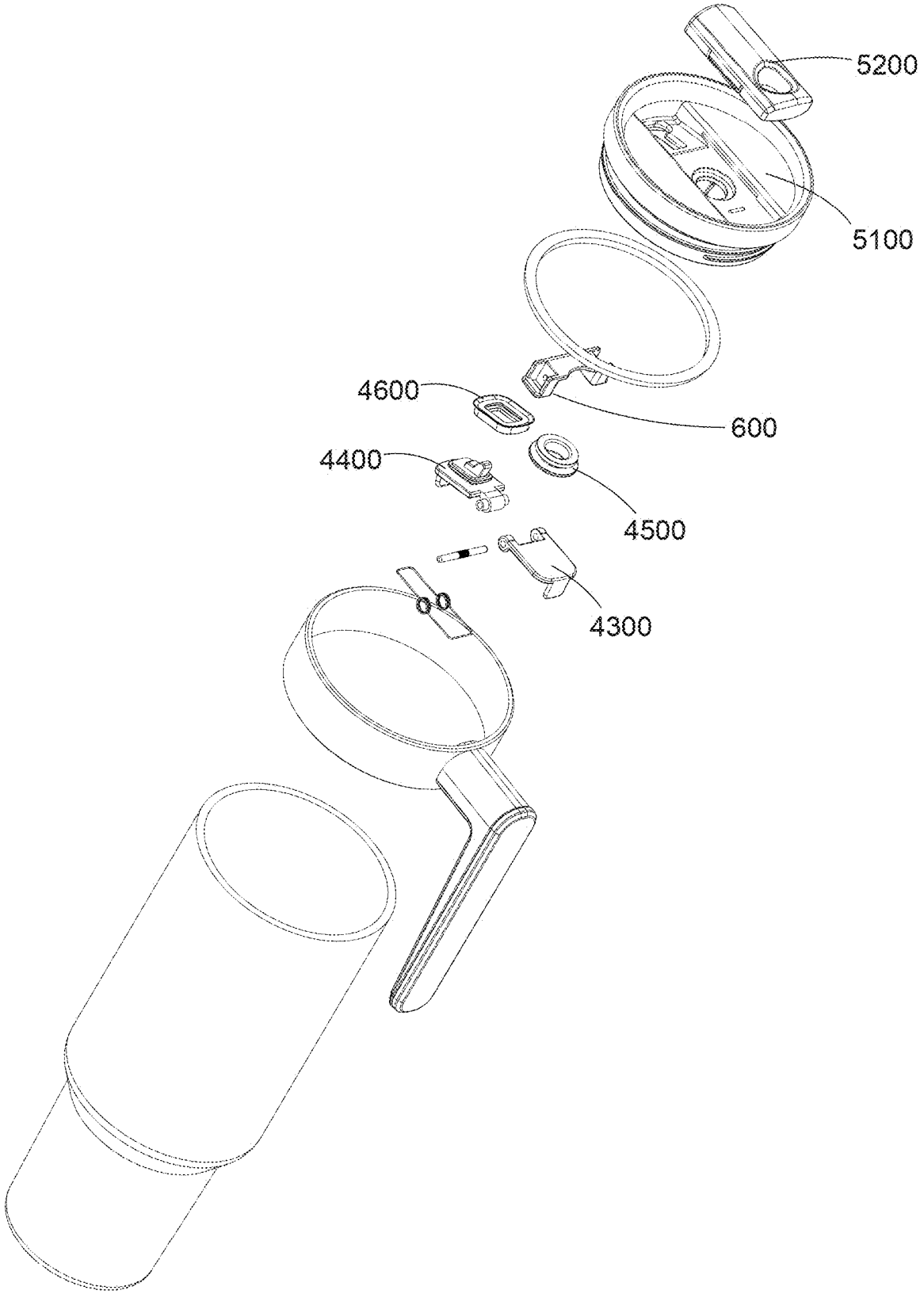
FIG. 19 shows the third embodiment of the lid assembly of the present invention.

FIG. 19 shows a third embodiment of the lid assembly of the present invention. The operation of the third embodiment is substantially the same as that of the first and second embodiments. Context below shows the differences between the third embodiment and the first & second embodiments.

Figure 20A:
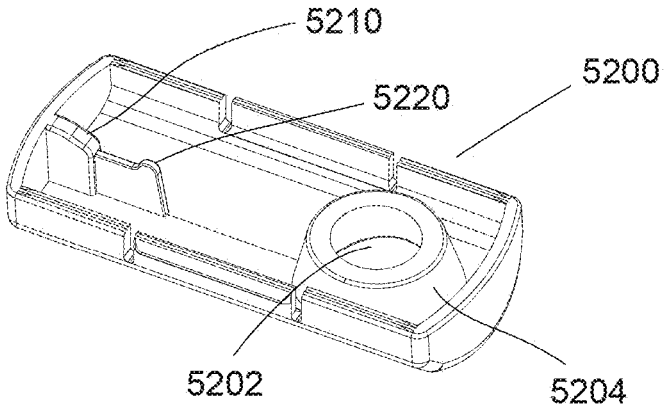
FIGS. 20A-20B show the trigger in different views.
Figure 20B:
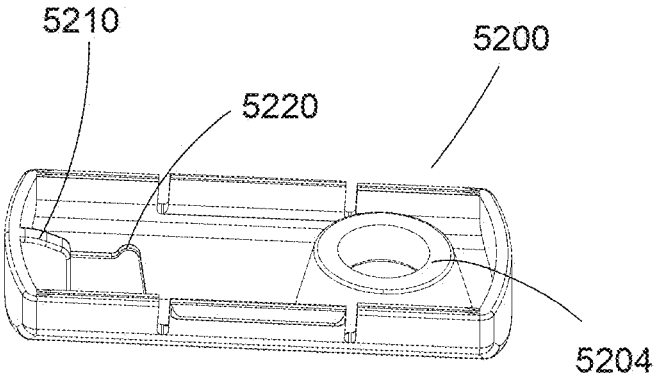

FIG. 20 shows the trigger 5200 in different views, in which FIG. 20A is a perspective bottom view with a first angle, FIG. 20B is a perspective bottom view with a second angle. On the underside of the top side of the trigger 5200 is provided with a collar 5204 (same as collar 4204 in FIG. 6) and a first actuating portion 5210 and a second actuating portion 5220. The first actuating portion 5210 and the second actuating portion 5220 are opposite said collar 5204 (see FIGS. 20A-B). It can be seen that both actuating portions stand from the underside of the top side of the trigger 5200, and the first actuating portion 5210 is taller than the second actuating portion 5220.

Figure 21A:
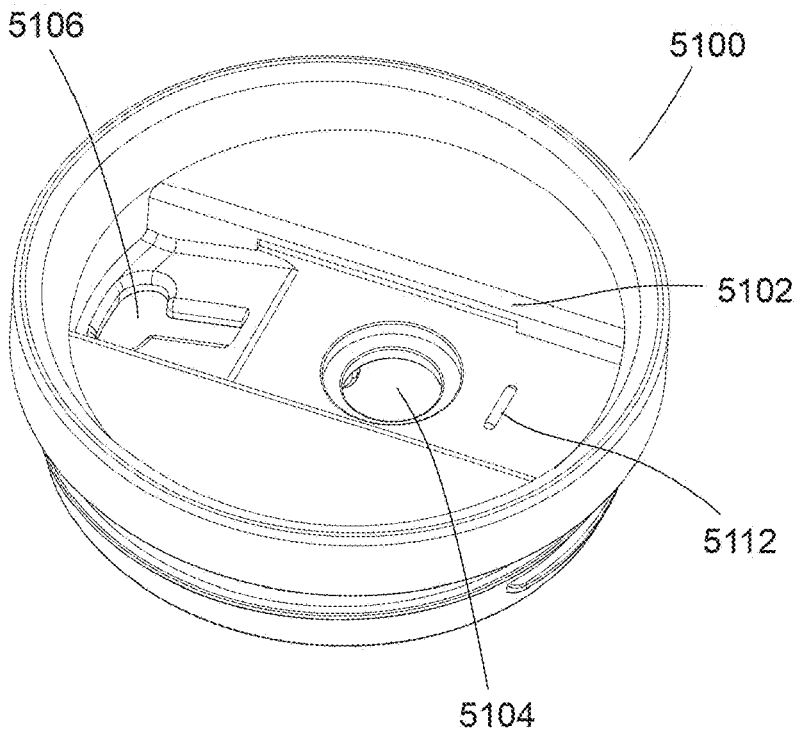
FIGS. 21A-21B show the base plate in different views.
Figure 21B:
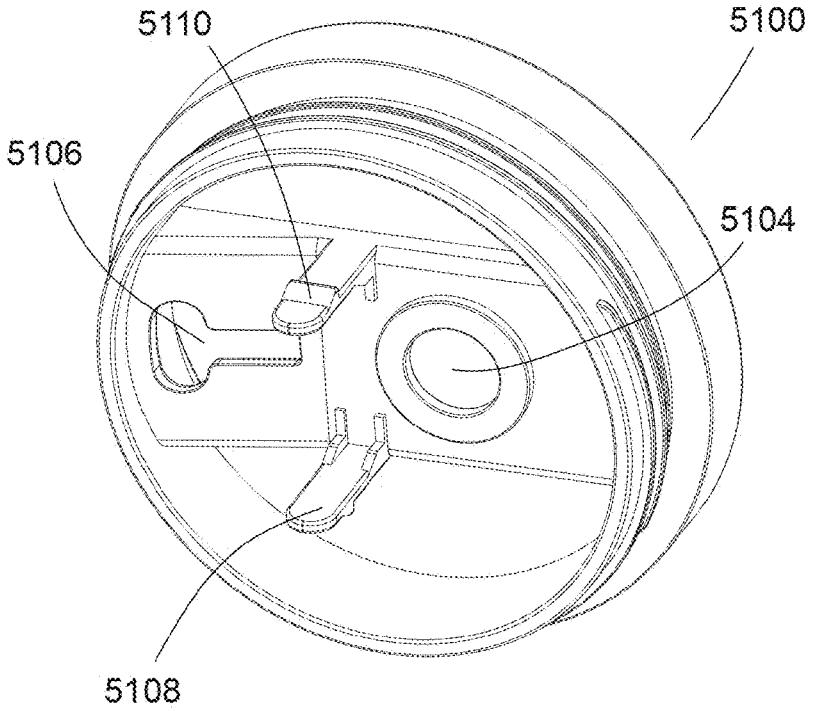

FIG. 21 shows the base plate 5100 in different views, in which FIG. 21A is a perspective top view and FIG. 21B is a perspective bottom view. The top surface of the base plate is provided with a chute 5102 profiled in rectangular shape having one end in a form of slope or ramp goes deeper than the other end (as seen in FIG. 21A). The chute 5102 is provided with a first aperture 5104, a second aperture 5106 adjacent the first aperture 5104, and a stopper 5112. Referring to FIG. 21A, it can be seen that the second aperture 5106 is provided at the slope or ramp. Referring to FIG. 21B, it can be seen that the underside of the top surface is provided with a pair of legs 5108 each with finger 5110 provided thereon.

Figure 22A:
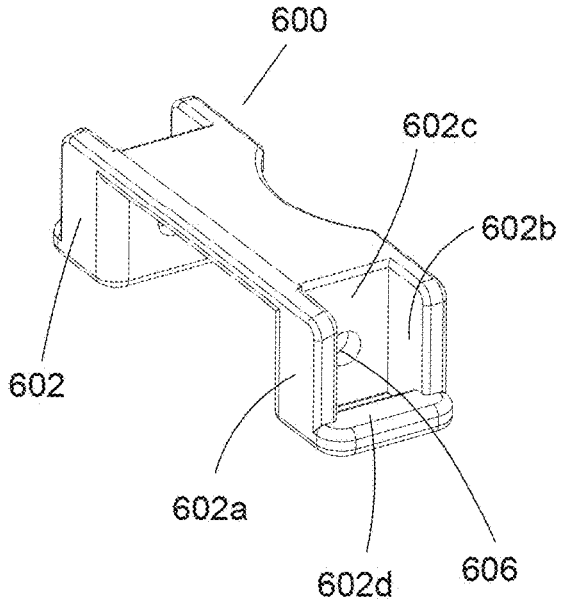
FIGS. 22A-22C show the connecting member in different views.
Figure 22B:
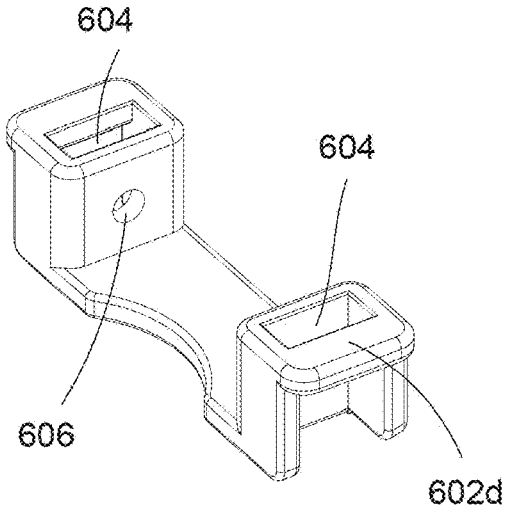
Figure 22C:
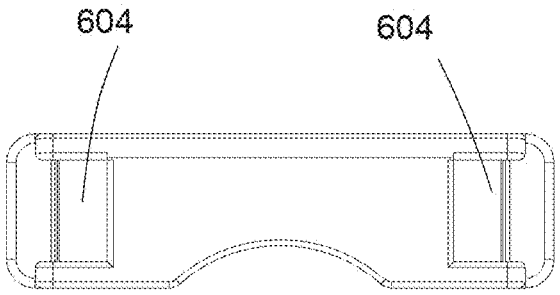

FIG. 22 shows the connecting member 600 in different view, in which FIG. 22A is the perspective top view; FIG. 22B is a perspective bottom view; and FIG. 22C is an elevation view. The connecting member 600 is shaped and profiled in a form of a bridge having two legs 602 each comprising a first wall 602*a*, a second wall 602*b*, a third wall 602*c*, and a lip 602*d*. Referring to FIG. 22B, it can be seen that there is provided with an aperture 604 between the third wall 602*c* and the lip 602*d*, and that on the third wall 602*c* there is provided with an aperture 606. It shall be understood that the walls 602*a*, 602*b*, 602*c*, which together with the lip 602*d* define a leg chamber for receiving the pair of legs 5108 of the base plate 5100, which will be explained in FIG. 23 showing the assembling between the connecting member 600 and the base plate 5100.

Figure 23A:
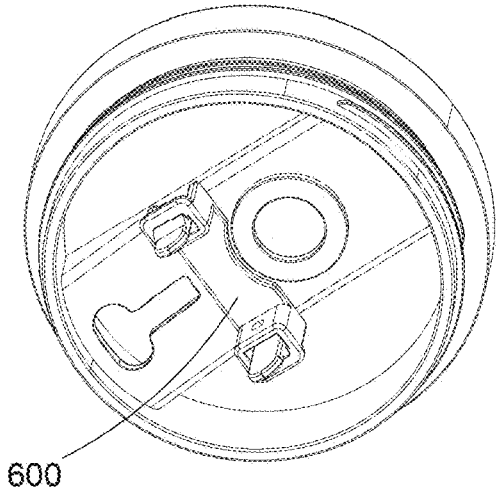
FIGS. 23A-23C show the perspective bottom view of the assembly between the base plate and the connecting member with different angle.
Figure 23B:
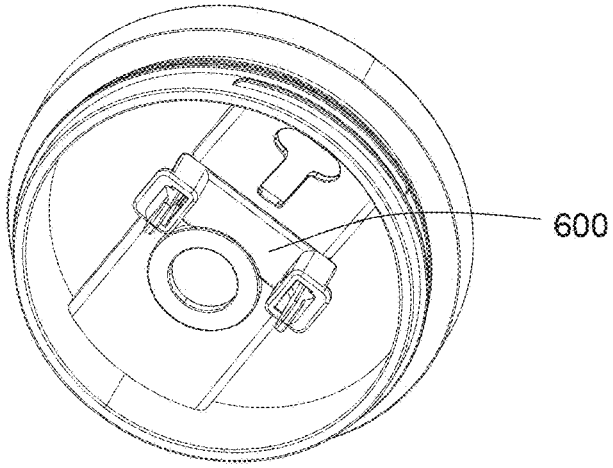
Figure 23C:
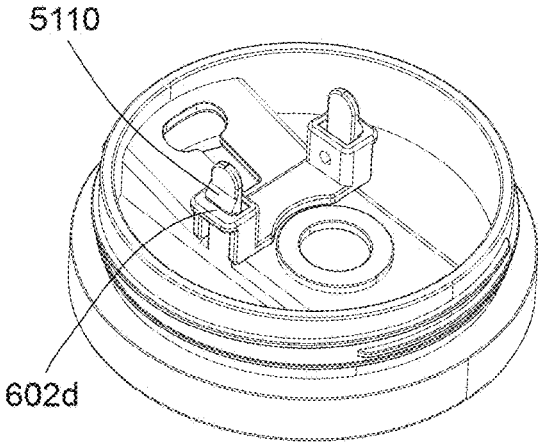

FIGS. 23A-C show the perspective bottom view of the assembly between the base plate 5100 and the connecting member 600 with different angles.

Referring to FIGS. 21-23, it shall be understood that the leg chamber of the connecting member 600 is profiled suitable to receive the pair of legs 5108. Preferably, the pair of legs 5108 is made of elastic material. When the legs 5108 are slightly pressed inwards, the legs 5108 are able to pass through the leg chambers of the connecting member 600, enabling the assembling between the connecting member 600 and the base plate 5100. When the connecting member 600 reaches the underside of the top side of the base plate, the inward force acting on the legs 5108 can then be removed, thereby relaxing the legs 5108 to its default state, allowing the finger 5110 of the leg 5108 sits on the lip 602*d* of the connecting member 600 (as illustrated in FIG. 23C), limiting the movement of the connecting member 600, i.e., preventing the connecting member 600 from falling down when the lid assembly is placed on top of the bottle.

Figure 24:
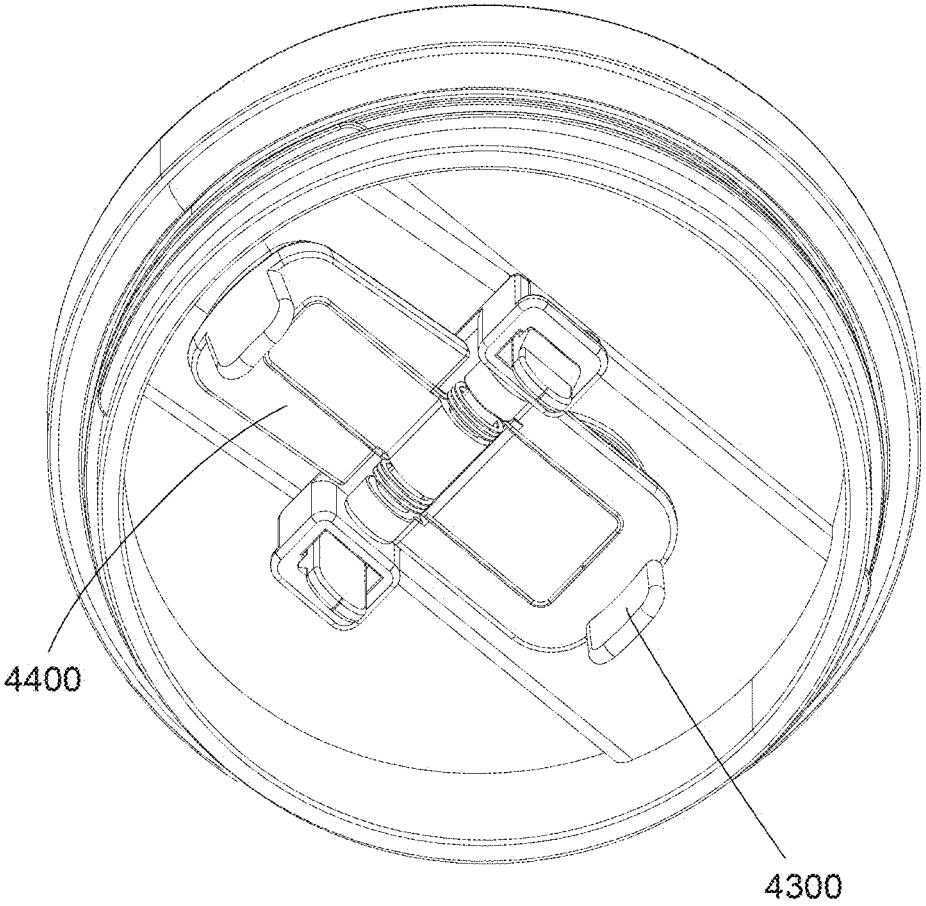
FIG. 24 shows the assembly between the base plate, the connecting member, the bias member, the first lever arm, and the second lever arm.

FIG. 24 shows the assembly between the base plate 5100, the connecting member 600, the bias member, the first lever arm, and the second lever arm.

Figure 25:
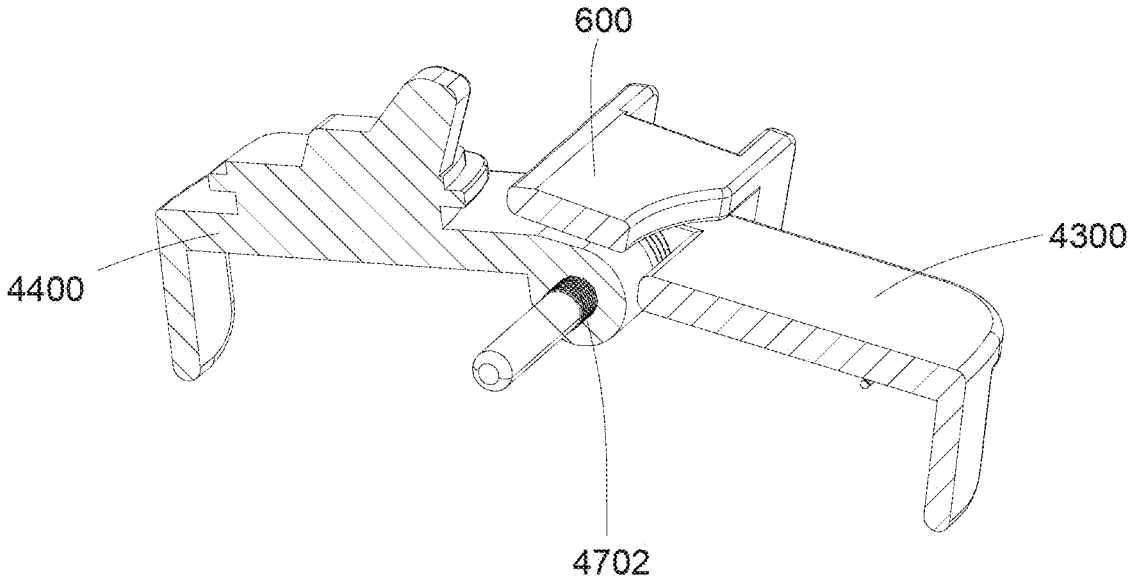
FIG. 25 is a cross-sectional view of the assembly between the first lever arm, the second lever arm, the axle, and the connecting member.

FIG. 25 shows the assembly between the first lever arm 4300, the second lever arm 4400, the axle 4700, and the connecting member 600. For clarity's sake, the sectional views of the first lever arm 4300, the second lever arm 4400, and the connecting member 600 are shown. It can be seen that the frictional portion 4702 of the axle 4700 is received in the connecting members 4408. More specifically, the knurls on the frictional portion 4702 engage with the inner perimeter of the connecting members 4408. Due to this configuration, when the second lever arm 4400 is pressed downwards, the second lever arm 4400 and the axle 4700 together rotate synchronously about the longitudinal axis of axle 4700 while the first lever arm 4300 remains stationary. On the contrary, when the first lever arm 4300 is pressed downwards, the first lever arm 4300 rotates about the axle 4700 however axle 4700 and the second lever arm remain stationary. It shall be understood that the operation mechanism of the illustration in FIG. 25 is the same as that in FIG. 15. It shall also be understood that the illustration in FIG. 25 is an example only. Those skilled in the art would and could arrange modification therefrom, which also falls into the scope of the present disclosure. For example, the knurls on the frictional portion 4702 can be configured to engage with the inner perimeter of the connecting members 4306 of the first lever arm 4300.

Referring to FIGS. 24-25, it can be seen that the axle, the first biasing member, the second biasing member, the first lever arm, the second lever arm, the connecting member can be assembled as a module before assembling to the base plate, providing ease to user for assembling.

Figure 26:
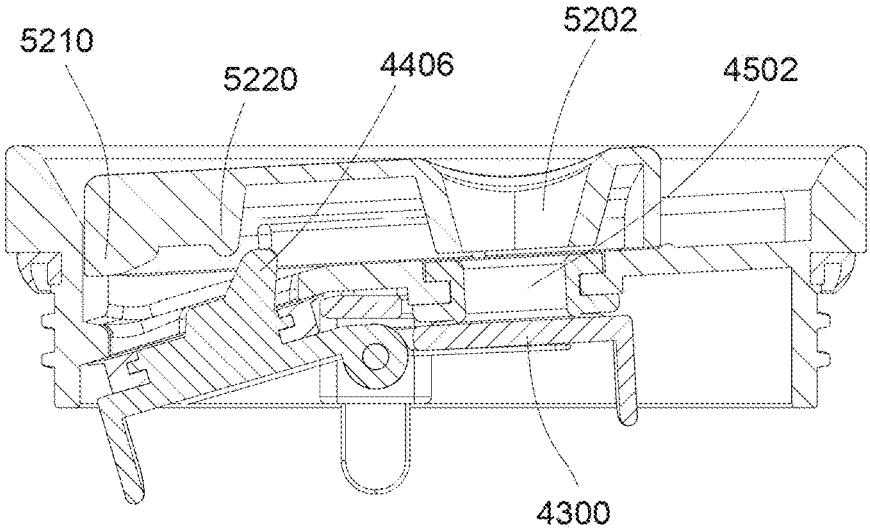
FIGS. 26-28 are schematic drawings showing the sliding of the trigger of the third embodiment of the lid assembly from its first position towards its second position.
Figure 27:
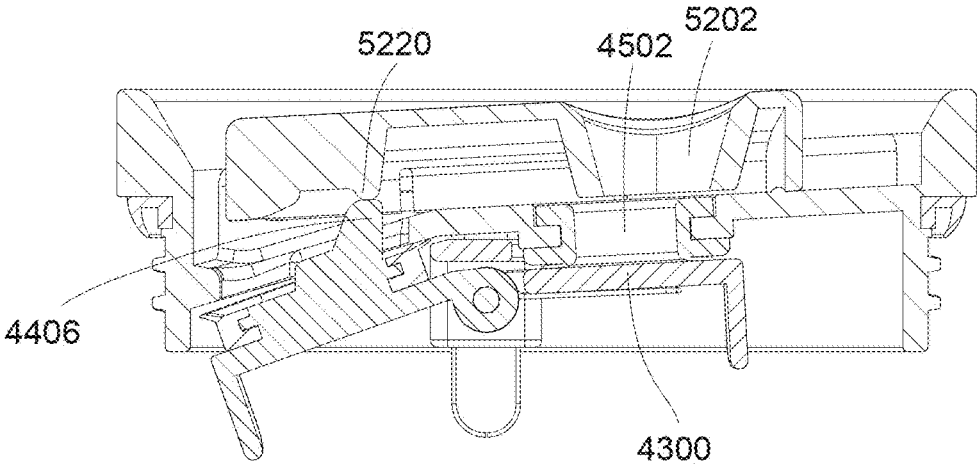
Figure 28:
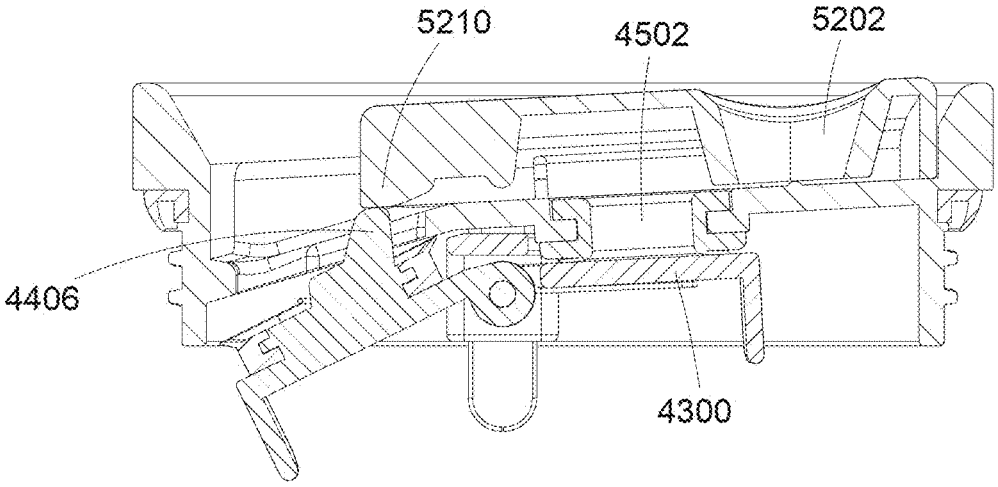

FIGS. 26-28 show how the trigger 5200 works in the third embodiment of the lid assembly of the present invention, and are schematic drawings showing the sliding of the trigger 5200 moving from its first position (FIG. 26) towards its second position (FIG. 28). In particular, the illustration in FIG. 26 and FIG. 28 correspond to the illustration in FIG. 16 and FIG. 18 respectively. Context below shows the differences between the trigger 5200 and the trigger 4200. FIG. 27 is the transition stage of the assembly when the trigger moves from its first position to its second position, and vice versa. As seen, the second actuating portion 5220 of the trigger 5200 slides over the engagement member 4406 of the second lever arm 4400, whereby imposing a downward force to the second lever arm to start rotating about the axle. At this moment, a small aperture is formed between the second seal 4600 and the underside of the top side of the base plate. Such a small aperture allows pressure release that may have developed inside the bottle. When the trigger 5200 in FIG. 27 slides further until at the second position, a first passageway as described above is formed.

Figure 29B:
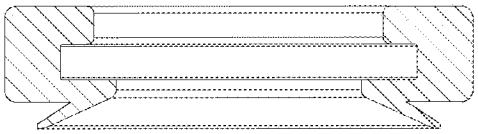
FIGS. 29A-29D show the first seal with different angle.
Figure 29D:
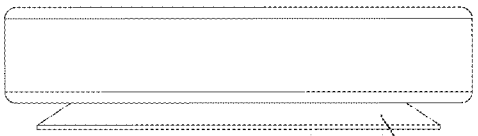
Figure 29A:
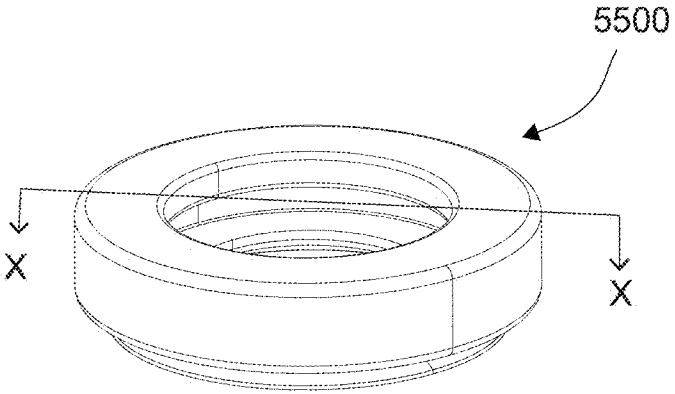
Figure 29C:
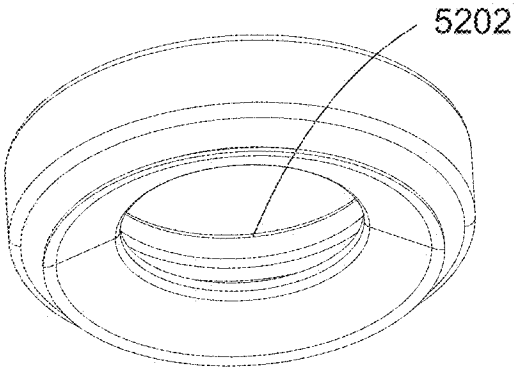

FIGS. 29A-29D show the first seal 5500 with different angles. FIG. 29A is a perspective elevation view, FIG. 29B is a cross-sectional view of the illustration along with the line X-X, FIG. 29C is a perspective bottom view, and FIG. 29D is a side view. In particular, FIG. 29C shows that the first seal 5500 is configured to provide with a first aperture 5202 and FIG. 29D shows that the first seal 5500 is provided with a skirt 5204.

Figure 30A:
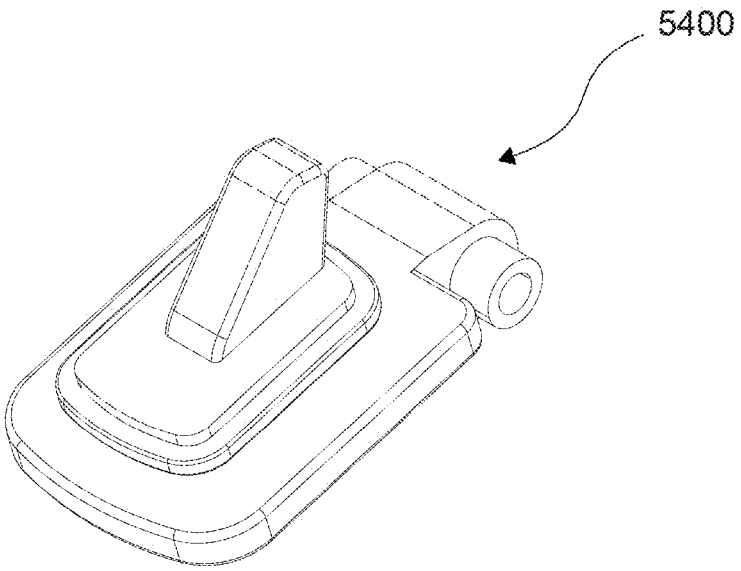
FIGS. 30A-30B show the second lever arm with different angle.
Figure 30B:
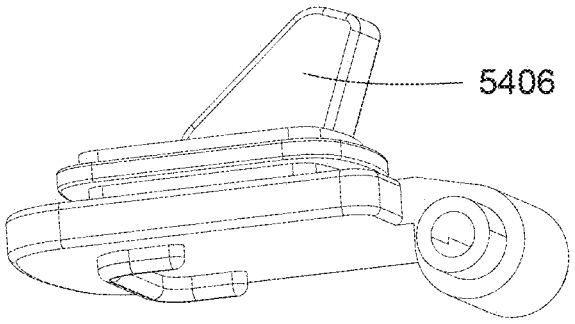

FIGS. 30A-30B show the second lever arm 5400 with different angles, in which FIG. 30A is the perspective elevation view and FIG. 30B is the perspective bottom view. As seen, the first seal 5400 is provided with an engagement member 5406.

Figure 31:
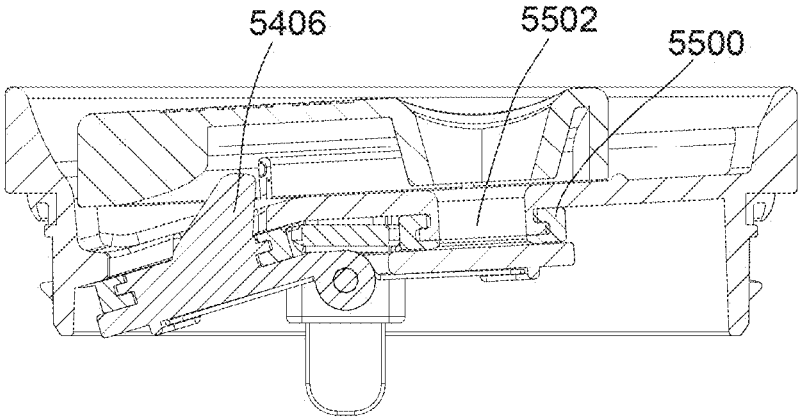
FIGS. 31-33 are schematic drawings showing the sliding of the trigger of the fourth embodiment of the lid assembly from its first position towards its second position.
Figure 32:
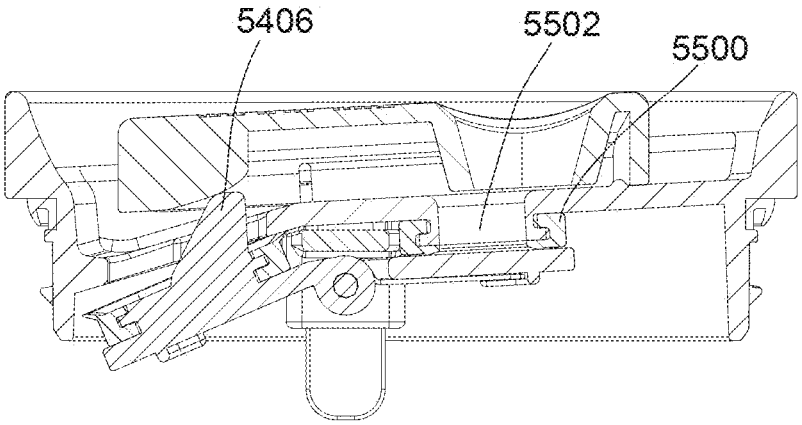
Figure 33:
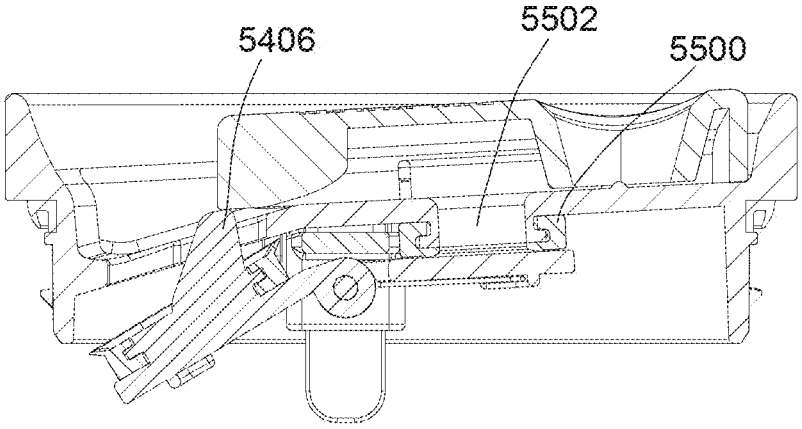

FIGS. 31-33 are schematic drawings showing the sliding of the trigger of the fourth embodiment of the lid assembly from its first position towards its second position. The operation mechanism for the illustrations in FIGS. 31-33 is the same as that in FIGS. 26-28. For brevity's sake, the operation mechanism for the illustrations in FIGS. 31-33 will not be repeatedly explained.

Figure 34:
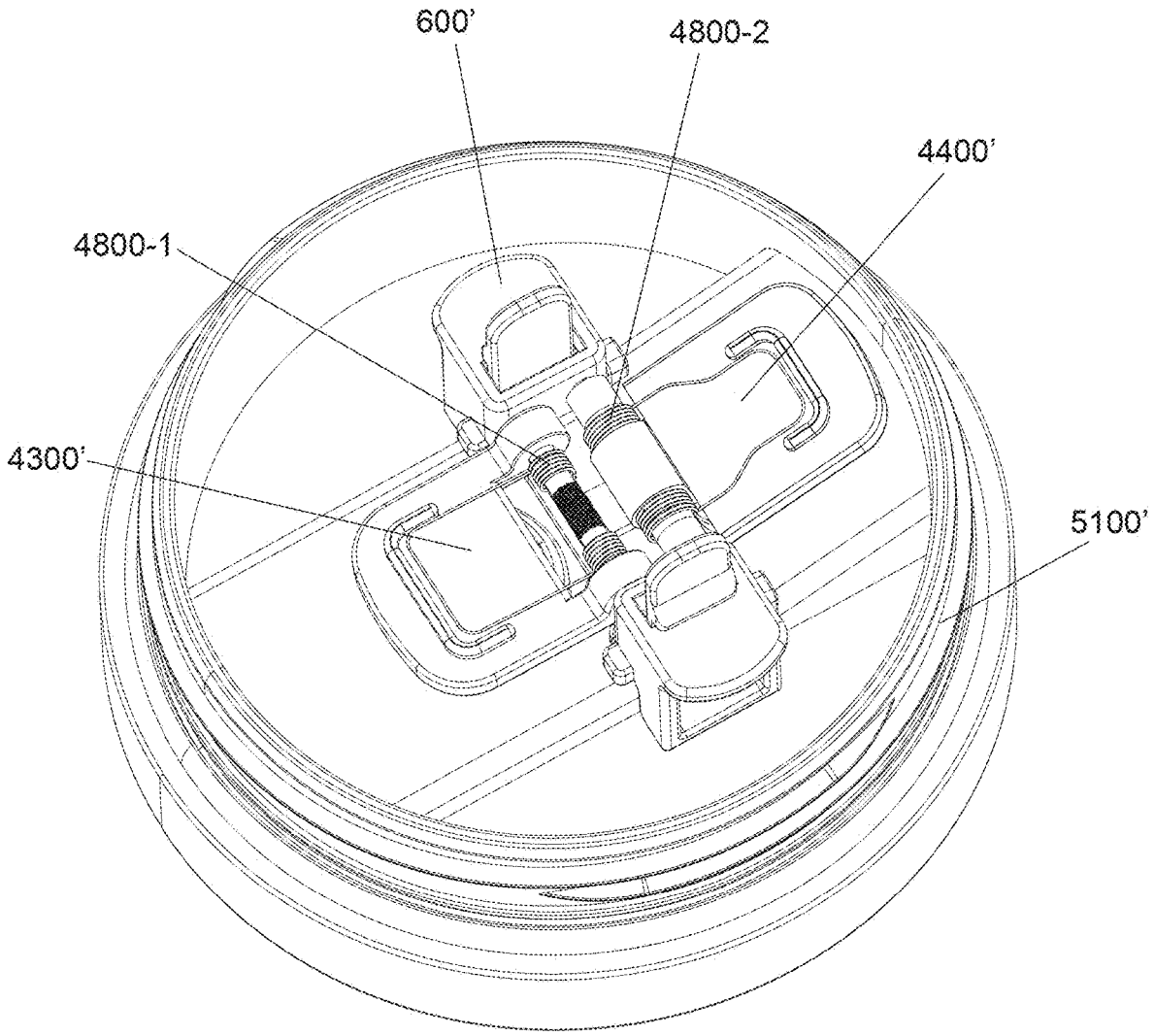
FIG. 34 shows the fourth embodiment of the lid assembly of the present invention.

FIG. 34 shows the fourth embodiment of the present invention. For brevity's sake, only the substantial differences from the previous illustrations are explained in the following. This embodiment comprising a base plate 5100' that can be attached to a container and has two openings, i.e., the first opening and the second opening as described above. The underside of the base plate 5100' is equipped with a pair of connecting members 600' as described above. Below the first opening of the base plate 5100', there is a first lever system comprising a first lever arm 4300' and a first biasing member 4800-1. The first lever system is pivotably connected to the connecting members 600' in a biased manner, allowing it to move between two positions. In the first position, the first lever arm 4300' closes the first opening of the base plate 5100' with a first seal, while in the second position, the first lever arm 4300' moves away from the first opening. In other words, it can be seen that the first lever arm is pivotably connected to said pair of connecting members via a first axle and said first biasing member such that said first lever arm can be reciprocally biased between its first position and second position. Similarly, below the second opening of the base plate 5100', there is a second lever system comprising a second lever arm 4400' and a second biasing member 4800-2. The second lever system is also pivotably connected to the connecting members 600' in a biased manner. It can be reciprocally biased between a first position, where the second lever arm 4400' closes the second opening of the base plate 5100' with a second seal, and a second position, where the second lever arm 4400' moves away from the second opening. In other words, it can be seen that said second lever arm is pivotably connected to said pair of connecting members via a second axle and said second biasing member such that said second lever arm can be reciprocally biased between its first position and second position. The second lever arm 4400' is designed with an engagement member that can be received in the second opening of the base plate 5100' as described in the previous embodiments. Additionally, the lid assembly in this embodiment includes the same trigger as described in the previous embodiments, its operation and function are the same as described in the previous embodiments. Based on the description above, it shall be understood that the present invention can use a single axle or two axles for biasing the first lever arm and the second lever arm. The biasing can be realized by a single biasing member or two biasing members, depending on actual needs. Although the embodiment in FIG. 34 illustrates variations or modifications based on the embodiment in FIG. 19, it shall be understood that these variations or modifications can also be applicable to the embodiment in FIG. 1 without technical hindrance. For brevity's sake, detailed description is not provided in this specification. Those skilled in the art would directly and unambiguously understand that by providing two pair of holes to the pair of connecting members 4108, two axles can be accommodated in the holes to realize the biasing operation for the first and second lever arms.

Configuration of the disclosed individual components in this context are examples only. The position, number, and shape of the components disclosed in this context are examples only. One skilled in the art shall not interpret it as a limitation to the present invention. It is to be expressly understood, however, that such modifications and adaptations are within the scope of invention in this aspect. Thus, it is intended that the present disclosure cover such modifications and variations and their equivalents. Features illustrated or described as part of one embodiment can be used on another embodiment to yield a still further embodiment. For example, the definition of the first lever system and the second lever system in the fourth embodiment can also be applicable to other embodiments. Components disclosed in this specification are examples only to explain the present invention, and shall not be construed as a limitation thereto. For manufacturing purpose, the disclosed individual components in this specification can be manufactured integrally or separately.

What is claimed is:

1. A lid assembly, for a container, comprising:

a base plate suitable for assembling to said container, configured to provide a first opening and a second opening, the underside of said base plate is provided with a pair of connecting members;

an axle, a first seal, a second seal, a first biasing member, and a second biasing member;

a first lever arm, positioned below said first opening of said base plate and pivotably connected to said pair of connecting members via said axle and said first biasing member such that said first lever arm can be reciprocally biased between a first position where said first lever arm closing said first opening of said base plate with said first seal and a second position where said first lever arm being away from said first opening of said base plate;

a second lever arm, positioned below said second opening of said base plate and pivotably connected to said pair of connecting members via said axle and said second biasing member such that said second lever arm can be reciprocally biased between a first position where said second lever arm closing said second opening of said base plate with said second seal and a second position where said second lever arm being away from said second opening of said base plate, wherein said second lever arm is provided to have an engagement member receivable in said second opening of said base plate;

a trigger comprising a first opening and an actuating portion, said trigger is configured to slide on the top side of said base plate between a first position where said first opening of said trigger being over said first opening of said base plate position and a second position where said actuating portion interacting with said engagement member of said second lever arm such that said second lever arm being biased to its said second position.

2. The lid assembly according to claim 1, wherein said first lever arm and said second lever arm are coaxially connected to said connecting member of said base plate via said axle.

3. The lid assembly according to claim 2, wherein said first biasing member and said second biasing member are integrally formed.

4. The lid assembly according to claim 1, wherein the top side of said base plate is provided with a chute inside which said first opening and said second opening of said base plate are arranged, said chute is profile to have a pair grooves at the laterals sides allowing said trigger sliding therein.

5. The lid assembly according to claim 4, wherein said chute is provided with a stopper aiding to hinder the sliding of said trigger from its said first position to its said second position.

6. The lid assembly according to claim 4, wherein said chute having a slope portion where said second opening of said base plate is arranged.

7. The lid assembly according to claim 1, wherein the underside of said base plate is provided with a pair of legs for securely receiving said pair of connecting members.

8. The lid assembly according to claim 7, wherein said pair of legs are made of resilient materials.

9. The lid assembly according to claim 7, wherein said pair of legs each is provided with a finger for securely receiving said pair of connecting members.

10. The lid assembly according to claim 7, wherein said axle, said first biasing member, said second biasing member, said first lever arm, said second lever arm, said connecting member can be assembled as a module before assembling to said base plate.

11. A lid assembly, for a container, comprising:

a base plate suitable for assembling to said container, configured to provide a first opening and a second opening, the underside of said base plate is provided with a pair of connecting members;

a first lever system comprising a first lever arm and a first biasing member, said first lever system positioned below said first opening of said base plate and is pivotably connected to said pair of connecting members in a biased manner by means of said first biasing member, such that said first lever system can be reciprocally biased between a first position where said first lever arm closing said first opening of said base plate with a first seal and a second position where said first lever arm being away from said first opening of said base plate;

a second lever arm system comprising a second lever arm and a second biasing member, said second lever system positioned below said second opening of said base plate and is pivotably connected to said pair of connecting members in a biased manner by means of said second biasing member, such that said second lever system can be reciprocally biased between a first position where said second lever arm closing said second opening of said base plate with a second seal and a second position where said second lever arm being away from said second opening of said base plate, wherein said second lever arm is provided to have an engagement member receivable in said second opening of said base plate;

a trigger comprising a first opening and an actuating portion, said trigger is configured to slide on the top side of said base plate between a first position where said first opening of said trigger being over said first opening of said base plate position and a second position where said actuating portion interacting with said engagement member of said second lever arm such that said second lever arm being biased to its said second position.

12. The lid assembly according to claim 11, wherein the top side of said base plate is provided with a chute inside which said first opening and said second opening of said base plate are arranged, said chute is profile to have a pair grooves at the laterals sides allowing said trigger sliding therein.

13. The lid assembly according to claim 12, wherein said chute is provided with a stopper aiding to hinder the sliding of said trigger from its said first position to its said second position.

14. The lid assembly according to claim 12, wherein said chute having a slope portion where said second opening of said base plate is arranged.

15. The lid assembly according to claim 11, wherein said first lever arm and said second lever arm are coaxially connected to said connecting member of said base plate via a common axle.

16. The lid assembly according to claim 11, wherein:— said first lever arm is pivotably connected to said pair of connecting members via a first axle and said first biasing member such that said first lever arm can be reciprocally biased between its first position and second position; and said second lever arm is pivotably connected to said pair of connecting members via a second axle and said second biasing member such that said second lever arm can be reciprocally biased between its first position and second position.

17. The lid assembly according to claim 11, wherein the underside of said base plate is provided with a pair of legs made of resilient materials for securely receiving said pair of connecting members, wherein said pair of legs each is provided with a finger for securely receiving said pair of connecting members.

18. The lid assembly according to claim 17, wherein said first lever system, said second lever system, and said connecting member can be assembled as a module before assembling to said base plate.

19. The lid assembly according to claim 18, wherein said first lever arm and said second lever arm are coaxially connected to said connecting member of said base plate via a common axle.

20. The lid assembly according to claim 18, wherein:— said first lever arm is pivotably connected to said pair of connecting members via a first axle and said first biasing member such that said first lever arm can be reciprocally biased between its first position and second position; and said second lever arm is pivotably connected to said pair of connecting members via a second axle and said second biasing member such that said second lever arm can be reciprocally biased between its first position and second position.

* * * * *